US005771426A

United States Patent [19]

Oka et al.

[11] Patent Number: 5,771,426

[45] Date of Patent: Jun. 23, 1998

[54] DEVELOPING DEVICE USING A TONER AND CARRIER MIXTURE

[75] Inventors: Seiji Oka, Yokohama; Kiyonori Tsuda, Tokyo; Hajime Oyama, Ichikawa; Fumihiro Sasaki, Fuji; Satoshi Mochizuki, Numazu; Takahisa Kato, Yokohama, all of Japan

[73] Assignee: Ricoh Company, Ltd., Tokyo, Japan

[21] Appl. No.: 633,687

[22] Filed: Apr. 19, 1996

[30] Foreign Application Priority Data

| | | | |
|---|---|---|---|
| Apr. 20, 1995 | [JP] | Japan | 7-119338 |
| Apr. 20, 1995 | [JP] | Japan | 7-119339 |
| Apr. 20, 1995 | [JP] | Japan | 7-119341 |
| Apr. 28, 1995 | [JP] | Japan | 7-129363 |
| May 2, 1995 | [JP] | Japan | 7-132687 |
| May 20, 1995 | [JP] | Japan | 7-145615 |
| May 18, 1995 | [JP] | Japan | 7-144122 |
| Jun. 16, 1995 | [JP] | Japan | 7-174420 |
| Mar. 22, 1996 | [JP] | Japan | 8-093593 |

[51] Int. Cl.[6] ..... G03G 15/04

[52] U.S. Cl. ..... 399/119; 399/27; 399/267; 399/274

[58] Field of Search ..... 399/267, 274, 399/258, 27, 30, 264, 119, 120, 222, 252, 254, 259, 265, 282, 262

[56] References Cited

U.S. PATENT DOCUMENTS

| | | |
|---|---|---|
| 4,550,998 | 11/1985 | Nishikawa . |
| 4,650,070 | 3/1987 | Oka et al. . |
| 4,799,608 | 1/1989 | Oka . |
| 4,969,557 | 11/1990 | Oka . |
| 5,077,584 | 12/1991 | Tanaka et al. . |
| 5,109,254 | 4/1992 | Oka et al. . |
| 5,133,283 | 7/1992 | Masuda . |
| 5,416,568 | 5/1995 | Yoshiki et al. . |
| 5,430,528 | 7/1995 | Kumasaka et al. . |
| 5,450,177 | 9/1995 | Oyama . |
| 5,526,100 | 6/1996 | Misago et al. . |

FOREIGN PATENT DOCUMENTS

| | | |
|---|---|---|
| 63-101958 | 7/1988 | Japan . |
| 2-54291 | 2/1990 | Japan . |
| 4-182682 | 6/1992 | Japan . |

*Primary Examiner*—Sandra L. Brase
*Attorney, Agent, or Firm*—Oblon, Spivak, McClelland, Maier & Neustadt, P.C.

[57] ABSTRACT

In a developing device for an image forming apparatus and of the type using a developer consisting of toner and magnetic carrier, a toner hopper has an opening for replenishing toner stored therein. The developer is regulated by a doctor blade to form a thin layer on a developing sleeve. The developer scraped off by the doctor blade is introduced into a developer storing chamber and caused to move toward the opening of the hopper due to its own internal pressure and gravity. The developer from the hopper is returned toward the doctor blade along the surface of the sleeve. The developer on the sleeve and regulated by the doctor blade is conveyed to a developing position where the sleeve faces an image carrier. The toner contained in the developer is a magnetic toner. When the toner concentration of the developer has reached an upper limit, a space or gap exists in the developer storing chamber.

40 Claims, 16 Drawing Sheets

DEVELOPING DEVICE USING A TONER AND CARRIER MIXTURE

FIELD OF THE INVENTION

BACKGROUND OF THE INVENTION

The present invention relates to a developing device for a copier, facsimile apparatus, printer or similar image forming apparatus. More particularly, the present invention is concerned with a developing device of the type having a developer carrier accommodating magnetic field generating means therein, and causing the developer carrier to convey a toner and magnetic carrier mixture to a position where it faces an image carrier for thereby developing a latent image formed on the image carrier.

Generally, a latent image electrostatically formed on an image carrier included in an image forming apparatus is developed by toner, i.e., single-ingredient type developer or by a toner and magnetic carrier mixture, i.e., two-ingredient type developer. In the toner and carrier mixture, fine toner particles are electrostatically deposited on the surface of each relatively great magnetic carrier particle due to friction acting therebetween. When the developer approaches the latent image, attraction acting on the toner due to an electric field formed by the latent image overcomes the force coupling the toner and carrier. As a result, the toner is transferred to the latent image to thereby convert it to a corresponding toner image. The mixture is repeatedly used while being replenished with fresh toner, as needed.

To reduce cost and size, a device for effecting the above development may be provided with a developer storing chamber in the vicinity of the developer carrier, e.g., a developing sleeve, as conventional. Then, while the developer deposited on the sleeve moves, it takes in the toner. However, the problem with this kind of scheme is that if control is executed to maintain the toner concentration of the developer in a preselected range, then an excessive increase in toner concentration brings about various problems including the contamination of the background and the flying of the toner. In any case, stable image density is not achievable unless the toner concentration is maintained constant.

There has also been proposed a developing device of the type using a toner replenishing member and a toner concentration sensor for maintaining the toner concentration of the developer constant. Although this type of device insures stable image density, it is bulky and complicated due to the toner replenishing member and other additional implementations.

In light of the above, a developing device capable of maintaining the toner concentration constant without resorting to a toner replenishing mechanism or a toner concentration sensor is disclosed in, e.g., Japanese Patent Laid-Open Publication No. 3-174175. For example, the device having the above capability has a developer storing portion for temporarily holding magnetic toner fed from a toner container due to gravity. The toner is replenished from the developer storing portion to a mixing portion and mixed with magnetic carrier stored therein beforehand. A developer carrier in the from of a roller conveys the toner and carrier mixture from the mixing portion along a transport path. Because the carrier is isolated from the toner container, it is retained in the vicinity of the developer carrier without being diffused toward the toner container. This, coupled with the fact that the toner is stably fed to the vicinity of the developer carrier, maintains the toner concentration of the developer on the developer carrier and the amount of the carrier constant.

Japanese Patent Publication No. 5-67233, for example, teaches a developing device having the following configuration. In a casing, a magnetic carrier forms a layer on the surface of a developer carrier accommodating a stationary magnet therein. Toner is stored in a toner replenishing section included in the casing and is held in contact with the developer. When the developer carrier is rotated, the carrier of the layer formed thereon moves while taking the toner thereinto at the replenishing section. The resulting toner and carrier mixture is regulated in thickness by a regulating member and conveyed to a developing position. The magnet does not have a pole facing the replenishing section; it has a pole at a position downstream of the replenishing section in the direction of rotation of the developer carrier, but upstream of the regulating member. A screen member faces the developer carrier and extends from a position downstream of the replenishing section to a position upstream of the regulating member. In this range, the magnetic field of the above pole acts. The screen member forms a region filled with the carrier between it and the developer carrier. When the toner concentration of the developer and therefor the volume of the developer increases, the packing ratio of the developer staying in the above region increases and slows down the movement of the developer. As a result, the developer in this region moves little except for the developer moving away from the regulating member. Conversely, when the volume of the developer decreases due to the consumption of the toner, the packing ratio in the above range decreases and promotes the movement of the developer. Consequently, the developer readily takes the toner therein. When the toner concentration of the developer again increases, the developer in the region again moves little and stops taking the toner therein.

Japanese Patent Application No. 6-295800, for example, discloses a developing device constructed as follows. While a developer carrier accommodating magnetic field generating means therein is rotated to convey a developer deposited thereon, a regulating member regulates the amount of the developer. A developer storing portion for the circulation of the developer is positioned upstream of the regulating member in the direction of rotation of the developer carrier. A toner storing portion is located upstream of the developer storing portion and formed with an opening for replenishing toner. The developer is conveyed by the developer carrier to a developing position by way of the regulating member. The developer removed by the regulating member is introduced into the developer storing portion and caused to move toward the opening due to gravity. After this part of the developer has taken the toner therein, it is returned toward the regulating member along the surface of the developer carrier. The device is expected to operate with two different kinds of developers each containing magnetic carrier having a particular charging ability. The device is capable of automatically controlling the toner concentration of the developer without resorting to the toner replenishing mechanism or the toner concentration sensor mentioned in relation to Publication No. 5-67233. In addition, the device allows the toner sufficiently charged during circulation in the developer storing portion to efficiently move to the developer deposited on the developer carrier.

Further, Japanese Patent Laid-Open Publication No. 55-98773, for example, discloses a developing device operable with the two-ingredient type developer and including rollers freely rotatable on opposite ends of the shaft of a developer carrier. The developer carrier is urged against an image carrier included in an image forming apparatus via the rollers, so that the gap between the developer carrier and the image carrier is adjusted. With this kind of scheme, it is possible to maintain the above gap constant without regard to the degree of circularity of the image carrier.

The device taught in the above Publication No. 5-67233 has the following problems. When the developer existing in the range filled with the carrier becomes relatively great in amount, the developer moves little except for the developer moving through the gap between the regulating member and the developer carrier. In this condition, when an image consuming a relatively great amount of toner is formed, it is difficult to replenish the toner to the developer which contributes to development. Moreover, when more than a necessary amount of carrier is set in the device, the toner concentration is critically lowered. Consequently, the flow of the developer capable of taking in the toner does not occur even when the image density is short. As the toner consumption further proceeds, the toner concentration reaches substantially 0 wt % and prevents desired image density from being achieved. Therefore, to promote the movement of the developer in the above region, it is preferable to set a relatively small amount of developer in the device. However, when the amount of the developer is excessively small, the toner concentration is locally increased. The resulting short charge of the toner causes the toner to contaminate the background and to fly about.

The above developing device cannot be loaded with as great an amount of developer as the conventional device using the two-ingredient type developer. Hence, when the device is applied to a high-speed machine causing the surface of the developer carrier to move at a high speed, it cannot deposit sufficient charge on the toner and brings about the problems stated above. This is also true with the device taught in previously mentioned Application No. 6-295800. When the device cannot be loaded with a great amount of developer, its application is limited only to an image forming apparatus with which a developer whose life is extremely short is acceptable (e.g. about several thousand printings). Another drawback is that counting means, for example, must be used to detect the time for replacing the developer so as to replace the developer frequently or replace the entire device.

On the other hand, even before the life of the developer ends, a sufficient amount of toner cannot be replenished into the developer if the toner is consumed. The short toner concentration immediately appears on the resulting image when the developing device cannot be loaded with a great amount of developer. For example, when the toner concentration decreases below a certain level without a toner end condition known, the magnetic carrier particles contact each other more frequency and have their films or coatings shaved off to an excessive degree. As a result, the ability of the carrier to charge the toner is noticeably reduced. This also gives rise to the previously discussed problems. Further, because the core of each carrier particle is lower in resistance than the coating, the resistance of the particle decreases with a decrease in the thickness of the coating and causes the particle to deposit on the image carrier. Moreover, when the carrier deposits on the image carrier, the amount of the carrier remaining in the developer, i.e., the amount of the developer becomes short. This brings about other various problems including the local omission of an image, the chipping of a cleaning blade, and damage to the image carrier and a fixing roller.

The developer to be set in the developing device has its toner charged when the toner and carrier are mixed on a production line. However, because the developer is usually left unused for a long period of time, the charge of the toner noticeably decreases due to self-discharge, compared to the charge under a regular developing condition. Hence, just after the developer has been set in the developing device disclosed in, e.g., Publication No. 5-67233, the toner is apt to deposit on the image carrier in a greater amount because it is easy to develop due to the low charge level.

In the device taught in Publication 5-67233, the carrier layer adjoining the surface of the developer carrier is separated into a moving layer and a stationary layer which are fully discrete from each other. The moving layer adjoins the developer carrier and moves due to the rotation of the developer carrier. The stationary layer overlies the moving layer and appears to be stationary. Because the developer takes in the toner via the opening in an amount controlled on the basis of the movement of the stationary layer, it is difficult to set the stationary layer. Hence, the device is operable only with magnetic carrier having a particular particle size and with a particular toner concentration; that is, it is difficult to set a toner concentration in such a manner as to control desired image quality. Moreover, the developer is not interchanged between the moving layer and the stationary layer at all, so that the carrier of the moving layer frequency contributes to the conveyance of the toner. This causes the toner to be spent and shaves off the coatings of carrier particles, thereby reducing the life of the developer.

Further, in the device proposed in Publication No. 5-67233, the toner supply is apt to become short when the toner is consumed in a great amount, e.g., when the area ratio of a document, i.e., the ratio of the image to the entire document is high. Subsequently, when an image of the kind consuming a minimum of toner is formed, the toner is apt to contaminate its background or flies about although the developer takes in a sufficient amount of toner. Moreover, the amount of the developer to be set in the device beforehand is determined by the particle size of the carrier. Hence, when the amount of the developer and the surface velocity of the developer carrier are increased, it is impossible to control the toner concentration or to deposit sufficient charge on the toner. As a result, a target toner concentration cannot be freely selected. Also, in the device disclosed in Laid-Open Publication No. 3-174175, because the toner concentration of the developer depends on the particle sizes and specific gravities of carrier and toner, only the toner concentration matching particular particle sizes of carrier and toner is available.

The device proposed in Laid-Open Publication 55-98773 has the following drawbacks. When the rollers fail to rotate smoothly due to the toner flown from around the developer carrier, friction acts between them and the image carrier and is likely to cause them to wear. When the outside diameter of each roller changes, it is impossible to maintain the gap between the developer carrier and the image carrier constant. As a result, although a bias for development and other conditions suitable for development may be set at first, defective images are produced. In addition, the image carrier and developer carrier are each not always accurately circular, as viewed in a section perpendicular to its axis. This is also apt to change the gap between the image carrier and the developer carrier.

Japanese Patent Laid-Open Publication No. 63-4282, for example, discloses a developing device having a first and a second toner regulating member. The second regulating member partitions a developer chamber and a toner chamber in the vertical direction. The second regulating member is located on the extension of the free end of the first regulating member or at the developer carrier side. Also disclosed is a developing device in which a path defined by the two regulating members is assigned to the supply of the initial developer to the developer carrier. A space for accommodating the initial developer is disposed above the path. However, the problem with such devices is that if the developer stored in the developer chamber is not uniformly set on the developer carrier in the axial direction of the developer carrier, the toner is supplied to the developer in an irregular distribution along the axis of the developer carrier. This results in an irregular image density distribution including locally short density and background contamination, as well as in the scattering of the toner from excessively high density portions.

To set the developer uniformly in the axial direction of the developer carrier, the operator is forced to perform a complicated procedure. Specifically, the operator must level the developer in the axial direction by moving back and forth the developer staying in the region where the force of the magnet does not act or by moving it in the direction of rotation of the developer carrier. Subsequently, the operator must drop the developer to the range where the force of the magnet acts, and then rotate the developer carrier.

Usually, in a factory, the developer is uniformly set on the developer carrier in the axial direction so as to avoid irregular development. However, during the transport of an image forming apparatus with the developing device to a destination, the developer is apt to drop due to shocks and impacts and locally concentrate in the axial direction of the developer carrier. This results in irregular development. Assume that the developing device is of the type requiring the user or the operator to introduce the developer into its developer storing section. Then, unless the developer is introduced slowly into the storing section, it is apt to directly drop to the bottom of the casing or to locally concentrate in the axial direction of the developer carrier. It is therefore extremely difficult to store the developer in such a manner as to avoid irregular development.

Before the developing device is used for the first time, the developer may be filled in the developer storing section with more than 1.3 times the usual amount in order to obviate the difference in toner concentration, as taught in, e.g., Japanese Patent Laid-Open Publication No. 3-144471. With this implementation, it is possible to prevent the developer from dropping from the developer carrier or locally concentrating during the course of transport, and therefore to eliminate the difference in image density ascribable to irregular development.

However, in the above construction, the more than necessary amount of developer remains in the developer storing section even during regular operation. In this condition, when the toner is sequentially consumed by development, the volume of the developer to deposit on the developer carrier decreases due to the toner consumption. As a result, it is likely that the developer dropped to the bottom of the casing without being magnetically deposited on the developer carrier before the device is actually used is again magnetically deposited on the developer carrier. This prevents the developer on the developer carrier from taking in the toner in the amount matching the consumed amount, resulting in irregular development. Although the developer with a desired toner concentration may be stored in the developer storing section beforehand, more than the necessary amount of magnetic particles will exist in the developer if the excess developer failed to deposit on the developer carrier is present in the storing section. Consequently, it is likely that a latent image is developed by the developer having a toner concentration different from the concentration in the storing section.

SUMMARY OF THE INVENTION

It is therefore an object of the present invention to provide a developing device using a two-ingredient type developer and capable of sufficiently charging toner even when applied to a high-speed image forming apparatus.

It is another object of the present invention to provide a developing device using a two-ingredient type developer and capable of providing a developer in a developer storing chamber with adequate conditions including density, so as to prevent the image density from decreasing, prevent it from increasing due to short toner charge, protect the background from contamination, and prevent the toner from flying about.

It is another object of the present invention to provide a developing device using a two-ingredient type developer and capable of automatically controlling the toner concentration of a developer at a desired upper limit without regard to the particle size of carrier.

It is a further object of the present invention to provide a developing device using a two-ingredient type developer and capable determining the upper limit of toner concentration under a condition in which a carrier covering ratio is 100% or below, thereby insuring stable images despite a change in the particle sizes of toner and carrier.

It is yet another object of the present invention to provide a developing device of the type using a two-ingredient type developer and capable of maintaining a gap between an image carrier and a developer carrier constant to thereby insure desirable images.

It is an additional object of the present invention to provide a developing device using a two-ingredient type developer and allowing the operator to set a developer therein in a desired uniform condition without resorting to troublesome manipulation.

It is another object of the present invention to provide a developing device using a two-ingredient type developer and capable of easily depositing an adequate amount of developer in a uniform distribution in the axial direction of a developer carrier, thereby insuring images free from irregularity.

In accordance with the present invention, a developing device has a developer carrier for conveying a developer consisting of toner and magnetic carrier and deposited thereon. A magnetic field generating member is accommodated in the developer carrier. A regulating member regulates the amount of the developer being conveyed by the developer carrier. A developer storing chamber temporarily stores a part of the developer removed by the regulating member. A toner storing chamber adjoins the developer storing chamber at the upstream side in the direction in which the developer carrier conveys the developer, and has an opening through which toner stored therein contacts the developer deposited on the developer carrier and the developer existing in the developer storing chamber. The developer removed by the regulating member moves toward the opening in the developer storing chamber due to its internal pressure and gravity. The developer taken in the toner from the toner storing chamber is conveyed toward the regulating member along the surface of the developer carrier. The developer regulated to a preselected amount by the regulating member is fed to a developing position where the developer carrier faces an image carrier.

In a preferred embodiment, in a range from substantially the intermediate between a regulating position assigned to the regulating member and adjoining the developer storing chamber and the opening to the opening, the developer has a mean density equal to or less than its apparent density, as measured by JIS Z2504 (metal powder apparent density test).

In another preferred embodiment, the developer set in the developer storing chamber has a toner concentration equal to or less than a saturation toner concentration which is the upper limit allowing the toner to be stably contained in the developer deposited on the developer carrier.

In another preferred embodiment the developer set in the developer storing chamber has a carrier concentration equal to or less than the amount in which the carrier would fill the developer storing section alone, as measured on the basis of an apparent density of the carrier by JIS Z2504.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
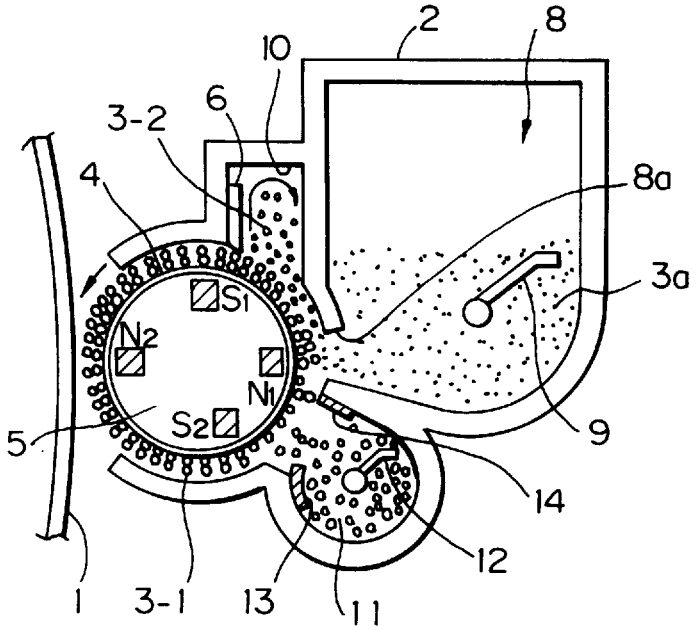
FIG. 1 is a sectional view showing a first embodiment of the developing device in accordance with the present invention.

Preferred embodiments of the developing device in accordance with the present invention and applied to an electrophotographic copier will now be described.

1st Embodiment

Referring to FIG. I of the drawings, a developing device embodying the present invention is shown and has a casing 2. The casing 2 is located at one side of an image carrier 1 implemented as a photoconductive drum by way of example. The casing 2 is formed with an opening facing the drum 1. A developing sleeve, or developer carrier, 4 is disposed in the casing 2 and partly exposed to the outside via the opening. A developer consisting of magnetic toner and magnetic carrier is retained on the surface of the sleeve 4. A cylindrical magnet member, or magnetic field generating means, 5 is fixed in place within the sleeve 4 and has a group of stationary magnets. A doctor blade, or regulating member, 6 regulates the amount of the developer deposited on the sleeve 4.

The casing 2 has thereinside a sleeve chamber accommodating the sleeve 4, a developer storing chamber 10 storing the developer scraped off by the doctor blade 6, a developer holding chamber 11, and a toner hopper 8 storing fresh toner 3*a* to be replenished into the developer deposited on the sleeve 4. Agitators 12 and 9 are positioned in the developer holding chamber 11 and toner hopper or toner storing chamber 8, respectively. The chamber 11 is used to temporarily hold the developer therein. Specifically, a magnetic member 13 is fitted on one edge of the opening of the chamber 11 in order to separate the developer from the sleeve 4. This part of the developer is taken into the chamber 11, mixed with the developer existing in the chamber 11 by the agitator 12, and then returned to the sleeve 4. As a result, damage to the developer mainly deposited on the sleeve 4 is minimized, so that the life of the developer is extended. This is particularly effective with a high-speed machine. Another magnetic member 14 is mounted on the other edge of the opening of the chamber 11. This member 14 forms a shield region by holding the developer thereon, thereby preventing the toner from dropping from the hopper 8 into the chamber 11.

The hopper 8 adjoins the developer storing chamber 10 at the upstream side of the chamber 10 in the direction in which the sleeve 4 conveys the developer. The hopper 8 has an opening 8*a* contacting the developer deposited on the sleeve 4 and forming a first toner layer, and the developer existing in the chamber 10 and forming a second developer layer. The agitator 9 is rotated at the time for replenishing the fresh toner 3*a* into the developer via the opening 8*a*. This is effected at a toner replenishing position where the developer on the sleeve 4 faces the opening 8*a*.

The sleeve 4 is a hollow cylindrical member made of a nonmagnetic material and has its opposite ends rotatably mounted on shafts parallel to the shaft of the drum 1. A drive section, not shown, causes the sleeve 4 to rotate in the direction indicated by an arrow in FIG. 1. The sleeve 4 may, of course, be replaced with an endless photoconductive belt passed over a plurality of rollers.

The magnet member 5 fixed in place within the sleeve 4 has four magnets magnetizing the surface of the sleeve 4 to N poles N1 and N2 and S poles S1 and S2. The magnet with the pole N1 conveys the developer 3-1 on the sleeve 4 to the doctor blade 6 together with the developer 3-2. The magnet with the pole S1 conveys the developer 3-1 scraped off by the doctor 6 toward a developing position where the sleeve 3-1 faces the drum 1. The magnet with the pole N2 conveys the developer 3-1 at the developing position. Further, the magnet with the pole S2 conveys the developer 3-1 moved away from the developing position toward the toner replenishing position. Of course, the N poles and S poles of the magnet member 5 may be replaced with each other.

In operation, while the sleeve 4 is in rotation, mainly the developer 3-1 forming the first layer on the sleeve 4 is conveyed toward the developing position while having its amount regulated by the doctor blade 6. At the developing position, the developer develops a latent image electrostatically formed on the drum 1. The developer 3-2 forming the second layer and removed by the doctor 6 moves, within the chamber 10, toward the opening 8*a* at a position remote from the sleeve 1 due to its own internal pressure and weight. The volume of the developer 3-2 varies in accordance with the toner concentration of the developer. Specifically, when the toner concentration is high, the area over which the developer 3-1 on the sleeve 4 and to be conveyed to the developing position in a great ratio contacts the fresh toner 3*a* is reduced. As a result, the amount of the toner 3*a* to be taken into the developer 3-1 is reduced. Conversely, when the toner concentration is low, the above area is increased with the result that the toner 3*a* is taken into the developer 3-1 in a greater amount. In this manner, the toner concentration of the developer 3-1 is maintained in a preselected range. With this configuration, the embodiment is capable of automatically controlling the toner concentration of the developer without resorting to the conventional toner replenishing mechanism or a toner concentration sensor.

The toner introduced into the developer 3-1 is conveyed toward the developing position while being charged due to friction acting between it and the carrier. On the other hand, the developer 3-2 forming the second layer turns round within the chamber 11 and has its toner also charged by friction.

The toner and carrier constituting the developer and applicable to the embodiment will be described in detail.

In the illustrative embodiment, use is made of toner containing at least a binder resin and a magnetic substance and produced by any of conventional methods. For example, the toner may be produced by melting and kneading a mixture of a binder resin, magnetic substance, coloring agent and polarity control agent by a heat-roll mill, solidifying the mixture by cooling, and then pulverizing and classifying it. The toner may contain any desired additive in addition to the above four ingredients.

For the binder resin, any conventional substance is usable. For example, the resin may be implemented by a polymer of polystyrene, poly-p-styrene, polyvinyl toluene or similar styrene and its substituent; styrene-p-chlorostyrene copolymer, styrene-polypropylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, ethyrene-butyl methacrylate copolymer, styrene-α-methyl chloromethacrylate copolymer, styrene-acryloniotrile copolymer, styrene-vinyl methyl ether copolymer, styrene-vinyl methyl ketone copolymer, styrene-butadiene copolymer, styrene-isoprene copolymer, styrene-maleic acid copolymer, styrene-maleic acid ester, or similar styrene copolymer; or polymethyl methacrylate, polybutyl methacrylate, polyvinyl chloride, polyvinyl acetate, polyethyrene, polypropyrene, polyester, polyurethane, polyamide, epoxy resin, polyvinyl butyral, polyacrylic acid resin, resin, rosin, denaturated rosin, terpen resin, phenol resin, aliphatic or aliphatic hydrocarbon resin, aromatic oil resin, paraffin chloride, or paraffin wax either singly or in combination. Particularly, when polyester resin is used, there can be obtained a developer resistive to binding to a vinyl chloride mat and desirable in heat-resistive offset against a heat roll.

The magnetic substance may be selected from a group of metals including magnetite, hematite, ferrite and other iron oxides, iron, cobalt, and nickel; and alloys of such metals with aluminum, cobalt, copper, lead, magnesium, tin, zinc, antimony, berillium, bismuth, cadmium, calcium, manganese, selenium, titanium, tungsten, and vanadium, and their mixtures. These ferromagnetic substances should preferably have a mean particle size of about 0.1 μm; in the toner, they should each have a content of about 20 parts by weight to 300 parts by weight, preferably 30 parts by weight to 200 parts by weight, for 100 parts by weight of resin.

The polarity control agent may also be implemented by any one of conventional substances including metal complexes of monoazo dyes, nitrohumic acid and its salts, Co, Cr, Fe and other metal complex amino compounds of salicylic acid, naphthoic acid, and dicarboxylic acid, quaternary ammonium compounds, and organic dyes. The polarity control agent is used in an amount depending on whether or not an additive or additives are present, and on the production method including a dispersion method. Preferably, 0.1 to 20 part by weight of polarity control agent is used for 100 parts by weight of binder resin. Contents smaller than 0.1 part by weight are not practical because the resulting amounts of charge are short. Contents greater than 20 parts by weight deposit excessive amounts of charge on the toner; the attraction between the toner and the carrier lowers the fluidity of the developer and the image quality.

A coloring agent may be added to the above toner, as needed. Exemplary coloring agents are black agents, cyan agents, magenta agents, and yellow agents. The black agents include carbon black, Aniline Black, furnace black, and lamp black. The cyan agents include Phthalocyanine Blue, Ethylene Blue, Methylene Blue, Victoria Blue, Methyl Violet, Aniline Blue, and ultramarine blue. The magenta agents include Rhodamine 6G Lake, dimethyl quinacridone, Wathcing Red, Rose Bengale, Rhodamine B, and Alizarin Lake. The yellow agents include chrome yellow, Benzidine Yellow, Hansa Yellow, Molybdenum Orange, Quinoline Yellow, and Tartrazine.

Additives which may be added to the toner include Teflon, zinc stearate and other lubricants, selium oxide, zirconium oxide, silicon, titanium oxide, aluminum oxide, silicon carbonate and other abrasives, coloidal silica, aluminum oxide and other fluidity agents, anti-caking agents, carbon black, and tin oxide and other conduction agents, polyolefin of low molecular weight and other fixation promoting agents. Among the fluidity agents, coloidal silica is preferable. Among the abrasives which grind the surfaces of the carrier, aluminum oxide and silicon carbonate are desirable.

The cores of the carriers may be implemented by, e.g., iron, cobalt, nickel or similar ferromagnetic metal, magnetite, hematite, ferrite or similar alloy or compound, or a compound thereof.

The surfaces of the carrier particles should preferably be covered with a resin in order to enhance durability. Resins usable for this purpose include polyethylene, polypropyrene, chlorinated polyethylene, chlorosulfonated polyethylene, and other polyolefin resins; polystyrene, acryl (e.g. polymethyl methacrylate), polyacrylonitrile, polyvinyl acetate, polyvinyl alcohol, polyvinyl butyral, polyvinyl chloride, polyvinyl carbazole, polyvinyl ether, polyvinyl ketone, and other polyvinylidene resins; vinyl chloride-vinyl acetate copolymer; styrene-acrylic acid copolymer; silicone resin having an organosilixane coupling, and its denaturated substances (e.g. derived from alkyd resin, polyester resin, epoxy resin, and polyurethan); polytetrafluoroethylene, polyvinyl fluoride, polyvinylidene fluoride, polychlorotrifuoroethylene, and other fluorine-contained resins; polyamide; polyester; polyurethane, polycarbonate; urea-formaldehyde resin and other amino resins, and epoxy resins. Among them, silicone resin and its denaturated substances and fluorine-contained resin, particularly silicone resin and its denaturated substances, are desirable.

The silicone resin may be selected from a group of conventional silicone resins. Typical of the silicone resins are straight silicone having only an organosiloxane coupling, and silicone resin denaturated by alkyd, polyester, epoxy, urethane or the like, as represented by the following formula:

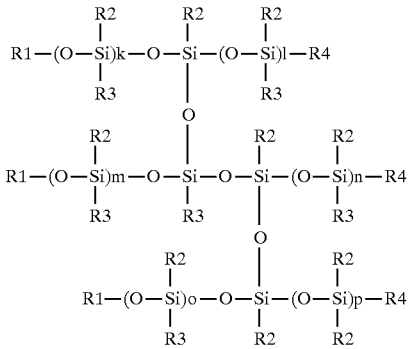

Eq. (1)

where R1 is a hydroxyl group, or alkyl group or phenyl group having one to four carbon atoms, and R2 and R3 are hydrogen groups, or alkoxy groups, phenyl groups or phenoxy groups having one to four carbon atoms, or alkenyloxy groups, hydroxy groups, carboxyl groups, ethyleneoxid groups or glycidyl groups having two to four carbon atoms, or groups expressed by the following formula:

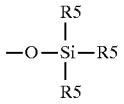

Eq. (2)

where R4 and R5 are hydroxy groups, carboxyl groups, alkyl groups having one to four carbon atoms, alkoxyl groups having one to four carbon atoms, alkenyl groups having two to four carbon atoms, alkenyloxy groups having two to four carbon atoms, phenyl groups, or phenoxy groups, and k, l, m, n, o and p are positive integers greater than 1, inclusive of 1.

The above substituents may have, e.g., amino acid, hydroxy groups, carboxyl groups, mercapto groups, alkyl groups, phenyl groups, ethylene oxide groups, glycidyl groups, and halogen atoms.

A conduction agent may be contained in the layer covering the carrier in order to control its volume resistivity. The conduction agent may be implemented by any conventional substances including, iron, gold, copper and other metals, oxides of ferrite and magnetite, and carbon black and other pigments. Among them, when use is made of a mixture of furnace black and acetylene black which belong to a family of carbon blacks, it is possible to effectively control the conductivity with a small amount of conductive powder and, in addition, to produce a carrier covered with a layer which is highly wear-resistant. Preferably, the conductive particle should have a particle size of about 0.01 $\mu$m to about 10 $\mu$m and should be added in an amount of 2 parts by weight to 30 parts by weigh, more preferably 5 parts by weight to 20 parts by weight, for 100 parts by weight of covering resin.

Further, the layer covering the carrier may contain a cylane coupling agent, titanium coupling agent or similar coupling agent in order to enhance the bond thereof with the particles as well as the dispersion of the conduction agent. The cylane coupling agent is a compound expressed by a general formula:

$$YRSiX_3 \qquad \text{Eq. (3)}$$

where X is a hydrolysis group, e.g., a chloro group, alcoxy group, acetoxy group, alkylamino group, or propenoxy group, Y is an organic functional group reactive to an organic matrix, e.g., a vinyl group, methacryl group, epoxy group, glycidexy group, amino group, or mercapto group, and R an alkyl group or an alkylene group having one to twenty carbons.

Among the cylane coupling agents, one having an amino group in Y is preferable when a developer chargeable to the negative polarity is desired. The epoxy cylane coupling agent having an epoxy group in Y is preferable when a developer chargeable to the positive polarity is desired.

The layer covering the carrier may be formed by applying a coating liquid to the surfaces of core particles by spraying, immersion or similar technology. The layer should preferably be 0.1 $\mu$m thick to 20 $\mu$m thick.

In the embodiment the toner-to-carrier ratio of the developer should preferably be between 10:90 and 50:50. When this kind of developer is used, it is possible to increase the toner holding ratio of the carrier and therefore the toner concentration of the first developer layer. Hence, the developer can implement desirable image density and thin line reproducibility even under developing conditions particular to a high-speed machine.

The toner should preferably have a saturation magnetization of 15 $A.m^2/kg$ to 30 $A.m^2/kg$ in a magnetic field of $8.0\times10^4$ A/m. This kind of toner can be readily taken into the developer. Hence even when images each consuming much toner are continuously produced, they are desirable in image density. In addition, the toner itself is magnetically restrained on the developing sleeve and effectively prevented from flying about or depositing on the background while the sleeve is in rotation.

The carrier should preferably deposit an amount of charge lying in the range of 10 $\mu$C/g to 80 $\mu$C/g in absolute value. Also, the carrier should not allow the amount of charge to change by more than 5 $\mu$C/g in absolute value when the toner-to-carrier ratio in weight is 10:90 to 50:50. With this kind of carrier, it is possible to maintain sufficiently high image density even when images each consuming much toner are continuously produced.

The carriers each has a volume resistivity ranging from $10^8$ Ωcm to $10^{16}$ Ωcm, preferably $10^9$ Ωcm to $10^{14}$ Ωcm. When this kind of carrier is used, the resistance of the developer is lowered at the developing position. As a result, a desirable solid image free from the edge effect is attainable.

In a magnetic field of $8.0\times10^4$ A/m, the carriers should each have a saturation magnetization preferably lying in the range of 30 A.m$^2$/kg. When use is made of this kind of carrier, the force restraining the developer on the developing sleeve at the developing position increases and prevents the developer from being deposited on the image carrier. Particularly, when the carrier is implemented as a binder carrier in which fine magnetic particles having a saturation magnetization between 80 A.m$^2$/kg and 110 A.m$^2$/kg in a magnetic field of $8.0\times10^4$ A/m are dispersed in a binder resin, a soft magnet brush can be formed on the sleeve and reproduces halftone in a desirable manner.

The carriers each has a weight mean particle size of 30 $\mu$m to 70 $\mu$m. This increases the toner concentration of the carrier of the first layer contributing to development at the developing position, i.e., the toner concentration of the first layer. This insures high image density and fine line reproducibility even under developing conditions particular to a high-speed machine.

Practical examples of the toner and carrier applicable to the the illustrative embodiment, and the results of experiments conducted with their combinations, or developers, will be described hereinafter.

[Toner 1]

A mixture having a composition listed in Table 1 below was melted and kneaded by a heat roll of 120° C., cooled to solidify, pulverized by a jet mill, and then classified to produce toner particles a having a mean particle size of 16 $\mu$m. The toner had a saturation magnetization of 16 A.m$^2$/kg in a magnetic field of $8/0\times10^4$ A/m.

TABLE 1

| | |
|---|---|
| styrene-acryl resin (Himer 75 available from Sanyo Kagaku) | 100 parts by weight |
| carbon black (#44 available from Mitsubishi Kasei) | 5 parts by weight |
| Nigrosine dye (Nygrosine Base EX available from Orient) | 2 parts by weight |
| fine magnetite particles (EPT-1000 available from Toda Kogyo) | 60 parts by weight |

[Toner 2]

The procedure for Toner 1 was repeated except for the use of a mixture shown in Table 2 below, thereby producing magnetic toner b. The toner had a saturation magnetization of 20 A.m$^2$/kg in a magnetic field of $8.0\times10^4$ A/m.

TABLE 2

| | |
|---|---|
| styrene-acryl resin (Himer 75) | 100 parts by weight |
| carbon black (#44) | 5 parts by weight |
| Nigrosine dye (Nygrosine Base EX) | 2 parts by weight |
| fine magnetite particles (EPT-1000) | 100 parts by weight |

[Toner 3]

The procedure of Toner 2 was repeated to produce toner particles c having a mean particle size of 8 $\mu$m. The toner had a saturation magnetization of 21 Am$^2$/kg in a magnetic field of $8.0\times10^4$ A/m.

[Toner 4]

The procedure of Toner 2 was repeated to produce mother particles having a mean particle size of 10 $\mu$m. 99.5 parts by weight of the mother particles and 0.5 part by weight of fine silica particles (R-972 available from Nippon Aerogel) were mixed by a mixer to produce a magnetic toner d having a mean particle size of 5 $\mu$m. The toner had a saturation magnetization of 22 A.m$^2$/kg in a magnetic field of $8.0\times10^4$ A/m.

[Toner 5]

A mixture having a composition listed in Table 3 below was melted and kneaded by a heat roll of 12020 C., cooled to solidify, pulverized by a jet mill, and then classified to produce mother particles having a mean particle size of 7 $\mu$m. 99.5 parts by weight of the mother particles and 0.5 part by weight of fine silica particles (R-972) were mixed by a mixer to produce a magnetic toner e having a mean particle size of 7 $\mu$m. The toner had a saturation magnetization of 21 A.m$^2$/ kg in a magnetic field of $8/0\times10^4$ A/m.

TABLE 3

| | |
|---|---|
| polyester resin (Mw = 55,000, Tg-62° C.) | 100 parts by weight |
| carbon black (#44) | 5 parts by weight |
| Nigrosine dye (Nygrosine Base EX) | 2 parts by weight |
| fine magnetite particles (EPT-1000) | 100 parts by weight |

[Toner 6]

A mixture having a composition listed in Table 4 below was melted and kneaded by a heat roll of 120° C., cooled to solidify, pulverized by a jet mill, and then classified to produce mother particles having a mean particle size of 7 $\mu$m. 99.5 parts by weight of the mother particles and 0.5 part by weight of fine silica particles (R-972) were mixed by a mixer to produce a magnetic toner f having a mean particle size of 7 $\mu$m. The toner had a saturation magnetization of 0 A.m$^2$/kg in a magnetic field of $8/0\times10^4$ A/m.

TABLE 4

| | |
|---|---|
| polyester resin (Mw = 55,000, Tg-62° C.) | 100 parts by weight |
| carbon black (#44) | 5 parts by weight |
| Nigrosine dye (Nygrosine Base EX) | 2 parts by weight |

[Carrier 1]

100 parts by weight of magnetite produced by a wet process, 2 parts by weight of polyvinyl alcohol, and 60 parts by weight of water were mixed by a ball mill for 12 hours to prepare a magnetite slurry. The slurry was sprayed by a spray drier to produce spherical particles having a mean particle size of 84 $\mu$m. The particles were baked at 1,000° C. for 3 hours in a nitrogen atmosphere and then cooled to obtain core particles 1. A mixture having a composition listed in Table 5 below was dispersed for 20 minutes by a homomixer to prepare a coating liquid 1.

TABLE 5

| | |
|---|---|
| silicone resin solution (SR-2410 available from Toray Dow Corning Silicone) | 100 parts by weight |
| toluene | 100 parts by weight |
| methyltrietoxysilane | 6 parts by weight |
| carbon black (#44; BET surface area = of $m^2$/g) | 10 parts by weight |

The coating liquid 1 was coated on the surfaces of 1,000 parts by weight of core particles 1 by use of a fluidized bed type coating device, thereby producing a carrier A coated with a silicone resin. The carrier A had a mean particle size of 87 μm, and a saturation magnetization of 65 $Am^2$/kg.

[Carrier 2]

100 parts by weight of magnetite produced by a wet process, 2 parts by weight of polyvinyl alcohol, and 60 parts by weight of water were mixed by a ball mill for 12 hours to prepare a magnetite slurry. The slurry was sprayed by a spray drier to produce spherical particles having a mean particle size of 60 μm. The particles were baked at 1,000° C. for 3 hours in a nitrogen atmosphere and then cooled to obtain core particles 2. The same coating liquid as in Carrier 1 was coated on the surfaces of 1,000 parts by weight of core particles 2 by use of a fluidized bed type coating device, thereby producing a carrier B coated with a silicone resin. The carrier B had a mean particle size of 63 μm and a saturation magnetization of 66 $A.m^2$/kg.

[Carrier 3]

The same coating liquid 1 as in Carrier 1 was coated on the surface of 1,0000 parts by weight of reduced ferrite (TEFV 200/300 available from Powder Tec) by use of a fluidized bed type coating device, thereby producing a carrier C. The carrier C had a mean particle size of 50 μm and a saturation magnetization of 79 $A.m^2$/kg.

[Carrier 4]

The same coating liquid 1 as in Carrier 1 was coated on the surface of 1,000 parts by weight of ferrite (F 150 available from Powder Tec) by use of a fluidized bed type coating device, thereby producing a carrier D. The carrier D had a mean particle size of 78 μm and a saturation magnetization of 55 $A.m^2$/kg.

[Carrier 5]

A mixture listed in Table 6 below was melted and kneaded, pulverized and classified to produce a carrier E. The carrier E had a mean particle size of 53 μm and a saturation magnetization of 32 $A.m^2$/kg.

TABLE 6

| | |
|---|---|
| polyester (condensation product of ethylene oxide-added bisphenol A and terephthalic acid) | 30 parts by weight |
| fine magnetite particles (mean particle size of 0.8 μm) | 70 parts by weight |

[Carrier 6]

100 parts by weight of magnetite produced by a wet process, 2 parts by weight of polyvinyl alcohol, and 60 parts by weight of water were mixed by a ball mill for 12 hours to prepare a magnetite slurry. The slurry was sprayed by a spray drier to produce spherical particles having a mean particle size of 31 μm. The particles were baked at 1,000° C. for 3 hours in a nitrogen atmosphere and then cooled to obtain core particles 3. A mixture listed in Table 7 below was dispersed for 20 minutes by a homomixer to prepare a coating liquid 2. The coating liquid 2 was coated on the surfaces of 1,000 parts by weight of core particles 3 by use of a fluidized bed type coating device, thereby producing a carrier F coated with a silicone resin. The carrier F had a mean particle size of 34 μm and a saturation magnetization of 69 $A.m^2$/kg.

TABLE 7

| | |
|---|---|
| silicone resin solution (SR-2410) | 100 parts by weight |
| toluene | 100 parts by weight |
| γ-chloropropyl trimethoxysilane | 15 parts by weight |
| carbon black (#44) | 20 parts by weight |

Table 8 shows Examples 1–10 of the present invention which are developers 1-1, 1-2, 1-3, . . . , 103 produced by mixing the toners and carriers of the above examples. Among the developers, developing devices having the construction of FIG. 1 were each mounted on a copier FT2200 (trade name) available from Ricoh and operated to form images. The resulting images were evaluated as to image density, presence/absence of carrier development, halftone reproducibility, and image density controllability.

For example, in Example 1, 11 parts by weight, 25 parts by weight and 100 parts by weight of toner a were each mixed with 100 parts by weight of carrier B by a ball mill to prepare three different developers 1-1, 1-2 and 1-3. The developers 1-1, 1-2 and 1-3 were measured to deposit 19 μC/g of charge, 13 μC/g of charge, and 11 μC/g of charge, respectively. The developing device of FIG. 1 using, among the above three developers, the developer having a toner concentration of 20 wt % was mounted on the copier FT2200, operated to produce images, and then evaluated as to the above factors.

Comparative Examples 1 also shown in Table 8 is representative of the results of tests executed for comparison. Specifically, 11 parts by weight, 25 parts by weight and 100 parts by weight of nonmagnetic toner f of Toner 6 were each mixed with 100 parts by weight of carrier B by a ball mill to prepare three different developers 11-1, 11-2 and 11-3. The developers 11-1, 11-2 and 11-3 were measured to deposit 7 μC/g of charge, 1 μC/g of charge, and 0 μC/g of charge, respectively. The above evaluation was performed with the developer 11-2 having a toner concentration of 20 wt %.

Specifically, Table 8 lists the results of evaluation executed with Examples 1–10 and Comparative Example 1 as to the amount of charge, image density, background contamination, present/absence of carrier development, halftone reproducibility, and image density controllability.

TABLE 8

| | Toner | Carrier | Toner Concentration | Developer | Change | Image Density | Contamination | Carrier Development | Halftone Reproducibility | Image Density Controllability |
|---|---|---|---|---|---|---|---|---|---|---|
| Ex. 1 | a | B | 10 wt % | 1-1 | 19 μc/g | 1.47 | ○ | ◎ | ○ | ○ |
| | a | B | 20 | 1-2 | 13 | | | | | |
| | a | B | 50 | 1-3 | 11 | | | | | |
| Ex. 2 | b | B | 10 | 2-1 | 21 | 1.44 | ○ | ◎ | ○ | ○ |

TABLE 8-continued

| | Toner | Carrier | Toner Concentration | Developer | Change | Image Density | Contamination | Carrier Development | Halftone Reproducibility | Image Density Controllability |
|---|---|---|---|---|---|---|---|---|---|---|
| | b | B | 20 | 2-2 | 17 | | | | | |
| | b | B | 50 | 2-3 | 14 | | | | | |
| Ex. 3 | c | B | 10 | 3-1 | 24 | 1.42 | ○ | ◎ | ○ | ◎ |
| | c | B | 20 | 3-2 | 22 | | | | | |
| | c | B | 50 | 3-3 | 19 | | | | | |
| Ex. 4 | d | B | 10 | 4-1 | 31 | 1.35 | ◎ | ◎ | ○ | ◎ |
| | d | B | 20 | 4-2 | 29 | | | | | |
| | d | B | 50 | 4-3 | 25 | | | | | |
| Ex. 5 | e | B | 10 | 5-1 | 26 | 1.40 | ◎ | ◎ | ○ | ◎ |
| | e | B | 20 | 5-2 | 25 | | | | | |
| | e | B | 50 | 5-3 | 23 | | | | | |
| Ex. 6 | e | A | 10 | 6-1 | 25 | 1.41 | ◎ | ◎ | ○ | ○ |
| | e | A | 20 | 6-2 | 22 | | | | | |
| | e | A | 50 | 6-3 | 19 | | | | | |
| Ex. 7 | e | C | 10 | 7-1 | 34 | 1.38 | ◎ | ◎ | ○ | ◎ |
| | e | C | 20 | 7-2 | 29 | | | | | |
| | e | C | 50 | 7-3 | 26 | | | | | |
| Ex. 8 | e | D | 10 | 8-1 | 26 | 1.41 | ◎ | ○ | ○ | ○ |
| | e | D | 20 | 8-2 | 23 | | | | | |
| | e | D | 50 | 8-3 | 20 | | | | | |
| Ex. 9 | e | E | 10 | 9-1 | 22 | 1.43 | ◎ | ○ | ◎ | ○ |
| | e | E | 20 | 9-2 | 19 | | | | | |
| | e | E | 50 | 9-3 | 15 | | | | | |
| Ex. 10 | e | F | 10 | 10-1 | 30 | 1.39 | ◎ | ○ | ○ | ○ |
| | e | F | 20 | 10-2 | 26 | | | | | |
| | e | F | 50 | 10-3 | 24 | | | | | |
| Com. Ex. 1 | f | B | 10 | 11-1 | 7 | 1.59 | x | ◎ | Δ | x |
| | f | B | 20 | 11-2 | 1 | | | | | |
| | f | B | 50 | 11-3 | 0 | | | | | |

In Table 8, double circles, circles, triangles and crosses respectively denote "excellent", "good", "average", and "poor", respectively. It will be seen that Examples 1–10 are good or excellent as to all the factors for evaluation.

2nd Embodiment

Figure 2:
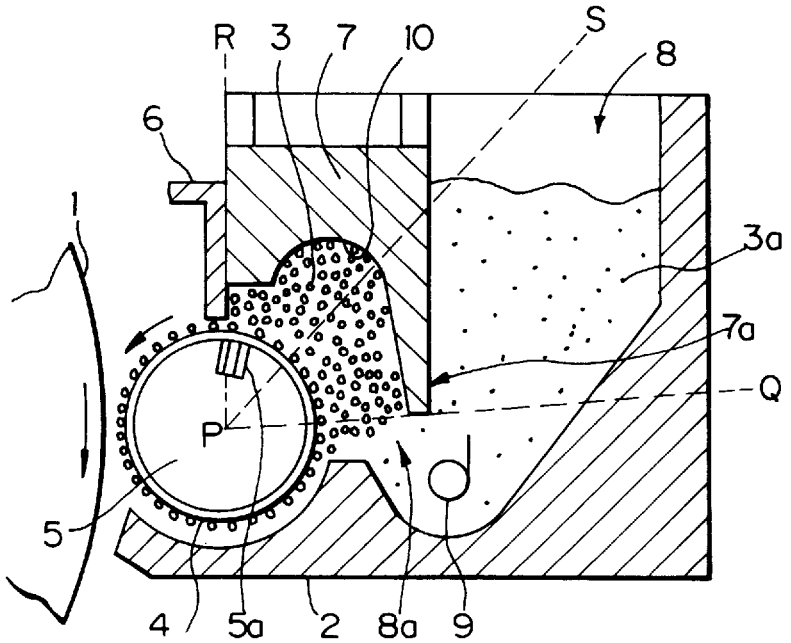
FIG. 2 is a sectional views showing a second embodiment of the present invention.

FIG. 2 shows another embodiment of the present invention. As shown, the casing 2 is located at one side of the drum 1 and formed with the opening facing the drum 1. The sleeve 4 is disposed in the casing 2 and partly exposed to the outside via the opening of the casing 2. The developer consisting of magnetic toner and magnetic carrier is deposited on the surface of the sleeve 4. The magnet member 5 is fixed in place within the sleeve 4 and has a group of stationary magnets. The doctor blade 6 regulates the amount of the developer deposited on the sleeve 4. The hopper 8 stores the fresh toner 3*a* to be replenished. In this embodiment, a canopy, or developer storing member, 7 precedes the doctor blade 6 with respect to the direction of rotation of the sleeve 4.

The canopy 7 forms the developer storing chamber 10 in which the developer 3 scraped off by the doctor 6 is temporarily stored. The magnet member 5 has a pole 5*a*, as well as other poles, not shown, facing the position where the chamber 10 adjoins the doctor 6. The agitator or agitating member 9 is disposed in the space adjoining the opening 8*a* of the hopper 8. The agitator 9 drives the toner 3*a* toward the opening 8*a* while agitating it.

The pole 5*a* is the essential feature of the magnet member 5 and located to face a projection or extension included in the canopy 7. The magnetic force of the pole 5*a* is selected such that it allows gravity to sufficiently join in the movement of the developer 3 in the chamber 10, but acts little on an edge portion 7*a* included in the canopy 7 and adjoining the opening 8*a*. To set up such a magnetic force distribution, the angle of the pole 5*a* is selected such that the flux density on the sleeve 4 is 50 mT to 80 mT and its half width is 20 degrees to 60 degrees, as measured over ±10 degrees about the axis P of the sleeve 4 with respect to the position where the pole 5*a* faces the extension of the canopy 7. In addition, the saturation flux density of the carrier is selected to be 50 $Am^2/kg$ to 90 $Am^2/kg$ (50 emu/g to 90 emu/g) while the maximum distance between the sleeve 4 and the inner wall of the canopy 7 is selected to be 10 mm or above.

Assume a line PQ extending from the axis P of the sleeve 4 toward the edge 7*a* of the canopy 7, a line PR extending from the axis P along the side of the doctor blade 6, and a line PS splitting the angle between the lines PQ and PR into two. Further, assume that a space delimited by planes which are respectively the extensions of the lines PS and PQ in the axial direction of the sleeve 4, the surface of the sleeve 4 and a plane in which the canopy 7 faces the sleeve 4 has a volume V. In addition, assume that the developer 3 actually existing in the volume V is W, and that the apparent density of the developer 3 is ρD as measured by JIS (Japanese Industrial Standards) Z2504 (metal powder apparent density test). Then, in the embodiment, the configuration of the canopy 7 determining the volume V and the weight W of the developer 3 are selected such that the weight W is smaller than the product of the volume V and apparent density ρD.

In the above configuration, the developer 3 is conveyed by the sleeve 4 in the direction indicated by the arrow while being regulated by the doctor blade 6 to form a thin layer. The thin layer of the developer 3 reaches the developing position where the sleeve 4 faces the drum 1 rotating in the direction also indicated by an arrow. As a result, the toner of the developer is transferred to the latent image formed on the drum 1, thereby developing it. The developer 3 left on the sleeve 4 without being transferred to the drum 1 is conveyed by the sleeve 4 toward the opening 8*a*. After the developer 3 has taken in the fresh toner 3*a* via the opening 8*a*, it is returned to the chamber 10. Because the developer 3 with the fresh toner has its internal pressure increased by the doctor blade 6, the toner contained in the developer 3 is charged. In this manner, the toner of the developer 3 deposited on the sleeve 4 is charged due to the internal pressure of the developer 3 adjoining the doctor blade 6. This eliminates the need for a complicated mechanism for charging or agitating the developer 3 and including a paddle, screw or the like.

The developer 3 removed by the doctor blade 6 from the sleeve 4 partly moves in the chamber 10 toward the opening 8*a* due to its own internal pressure and gravity. This part of the developer 3 approached the opening 8*a* is circulated toward the blade 6 due to the movement of the developer existing on the sleeve 4, i.e., turns round in the chamber 10.

Figure 3A:
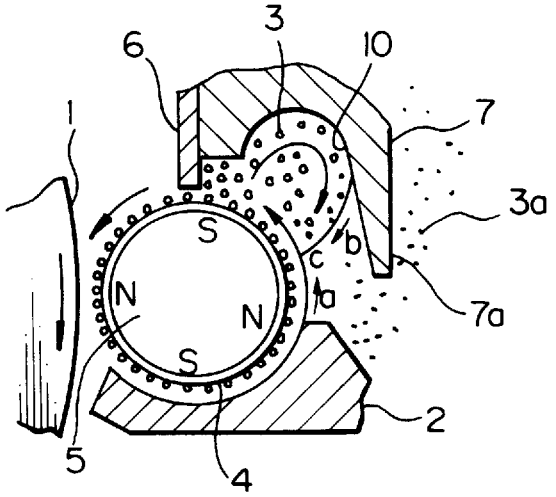
FIGS. 3A–3C are sectional views demonstrating how toner is replenished into carrier in the embodiment of FIG. 2.
Figure 3B:
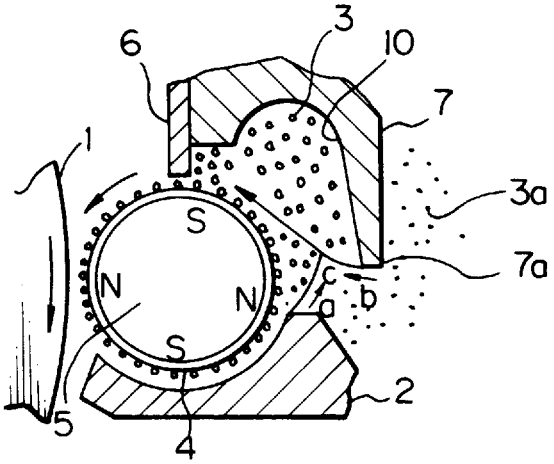
Figure 3C:
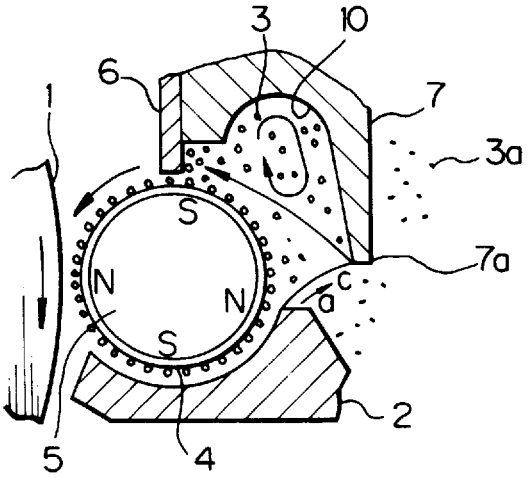

FIGS. 3A–3C demonstrate how toner of different color is introduced into the developer 3 turning round in the chamber 10. This was observed in an enlarged side view through a high-speed video camera operated at a rate of 200 frames/sec and at ten times higher speed. As shown, the developer 3 in the chamber 10 and being conveyed toward the downstream side, i.e., toward the doctor blade 6 is partly directed toward the canopy 7 above the sleeve 4 due to gravity and the magnetic field formed by the magnet member 5. As a result, this part of the developer 3 turns round in the chamber 10.

As shown in FIG. 3A, the fresh toner which comes out of the hopper 6 is taken into the developer 3 in the vicinity of a point c where two flows a and b join each other. At this instant, the moving layer of the developer is moving at a rate of about 100 mm/sec in the vicinity of the surface of the sleeve 4. The layer of the developer 3 staying in the chamber turns round at a rate of about 10 mm/sec because a sufficient space is still available in the chamber 10.

As shown in FIG. 3B, the toner concentration of the developer 3 sequentially increases, causing the moving layer of the developer 3 to expand. Then, the point c sequentially moves away from the surface of the sleeve 4. At the same time, the developer flowing in the direction a in the vicinity of the surface of the sleeve 4 is lowered in speed. As a result, the developer 3 moves at a rate of about 65 mm/sec in the vicinity of the sleeve 4 while the layer staying in the chamber 10 turns round at a rage of about 5 mm/sec.

As shown in FIG. 3C, as the amount of the toner replenished into the developer 3, i.e., the toner concentration of the developer 3 further increases, the volume of the developer 3 also further increases. This sequentially lowers the fluidity of the developer 3. Because the moving layer of the developer sequentially expands, the point c sequentially approaches the edge 7*a* of the canopy 7. As a result, the fresh toner is not taken into the developer 3 any more. At this time, the layer of the developer staying in the chamber 10 is turning round at a rate of about 1 mm/sec. However, the staying layer in the chamber 10 still has a loose portion in which the toner concentration is higher than the other portion. This part of the staying layer is continuously turning round although its speed is extremely low; the dispersion of the toner into the developer and charging are under way.

The toner is sequentially consumed by repeated development until the toner concentration of the developer in the chamber 10 decreases, so that the volume of the developer 3 decreases. As a result, the condition shown in FIG. 3A is set up again and allows the toner to be taken into the developer.

As stated above, the volume of the developer 3 in the chamber 10 varies in accordance with the condition in which the toner is taken into the developer 3, thereby automatically controlling the toner concentration. Therefore, the toner concentration of the developer 3 is held in a substantially constant range. This eliminates the need for a complicated toner concentration control mechanism including a toner concentration sensor and toner replenishing member.

It is to be noted that not only the toner 3*a* replenished into the developer 3 but also the charged toner dispersed in the developer 3 while turning round in the chamber 10 are conveyed to the developing position.

As stated above, in this embodiment, a great amount of charged toner is available for development. Even when the fresh toner is replenished from the hopper 8 into the developer in a great amount, it is dispersed in the developer 3 while turning round in the chamber 10. This toner and the toner already charged in the chamber 10 are conveyed to the developing position. Therefore, the embodiment is free from the occurrence that the short charge of toner causes the toner to contaminate the background or to fly about, as discussed in relation to Japanese Patent Publication No. 5-67233 previously.

Further, the embodiment allows the developer in the chamber 10 and the developer on the sleeve 4 to replace each other in a higher ratio than the above Publication No. 5-67233. For a given amount of developer, the embodiment decelerates the shaving of the films covering the carrier of the developer 3 and the spending of the toner more than Publication 5-67233. As a result, the embodiment reduces the flying of the toner and background contamination ascribable to the decrease in charge, background contamination, and carrier deposition ascribable to the decrease in the electric resistance of the developer. It may therefore be safely said that the embodiment is advantageous over Publication 5-67233 in respect of the service life of the developer.

Figure 4:
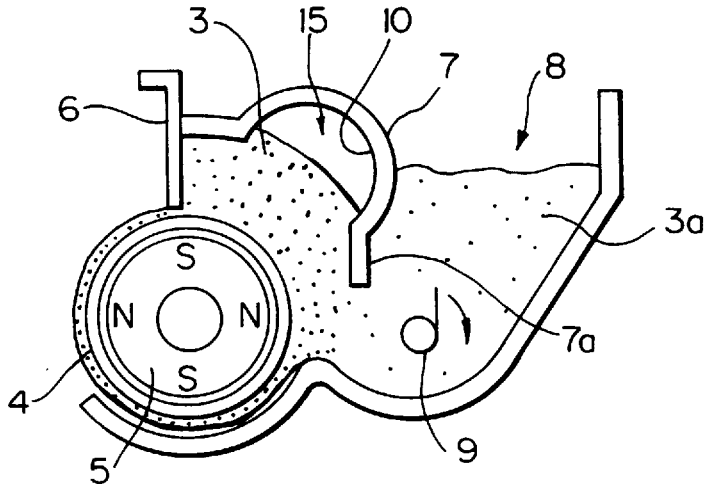
FIGS. 4 and 5 are sectional views each showing a particular modification of the embodiment of FIG. 2.

As shown in FIG. 4, a gap 15 where the developer 3 is almost absent and does not contact the inner surface of the canopy 7 should preferably be formed in the portion where the distance between the surface of the sleeve 4 and the above surface of the canopy 7 is maximum. In this case, the developer 3 will surely turn round in the chamber 10. The distance between the sleeve 4 and the canopy 7 for forming the gap 15 depends on the strength of the magnetic field to be formed by the pole 5*a*; the weaker the field strength, the shorter the distance is.

Figure 5:
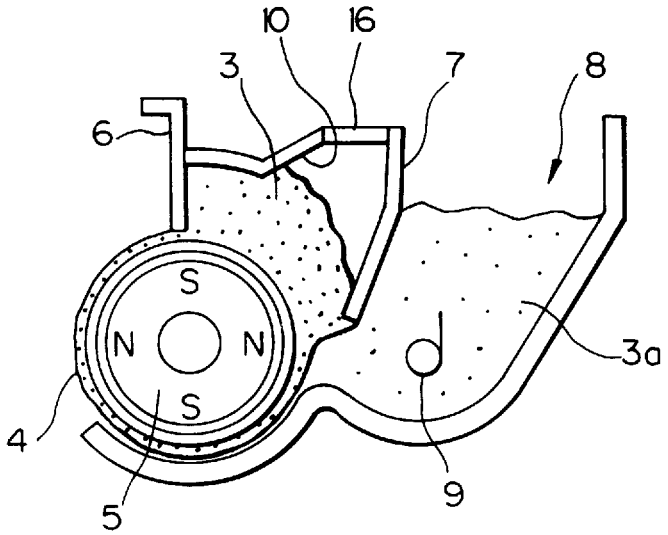

As shown in FIG. 5, a filter 16 may be fitted in an air vent formed in the canopy 7. The air vent prevents the air pressure within the chamber 10 from increasing. As a result, the air pressure in the developer reached the developing position is lower than in the arrangements shown in FIGS. 2 and 4, thereby reducing the contamination of the interior of the machine due to the toner.

Figure 6A:
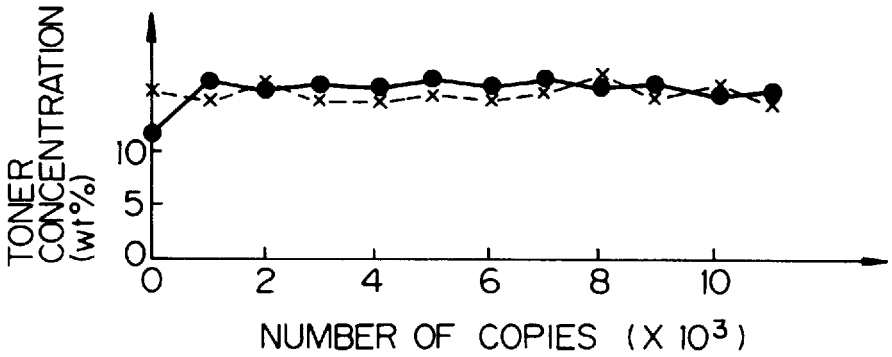
FIG. 6A shows a relation between the number of copies and the toner concentration particular to a copier implemented by another modification of the embodiment of FIG. 2.
Figure 6B:
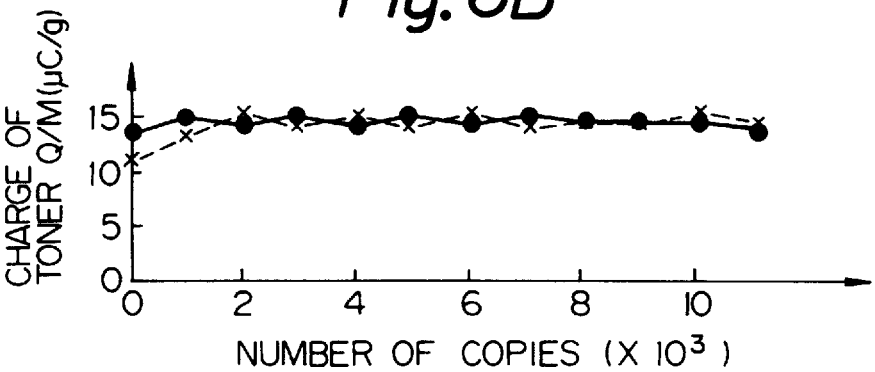
FIG. 6B shows a relation between the number of copies and the amount of charge deposited on toner and also particular to the copier.
Figure 6C:
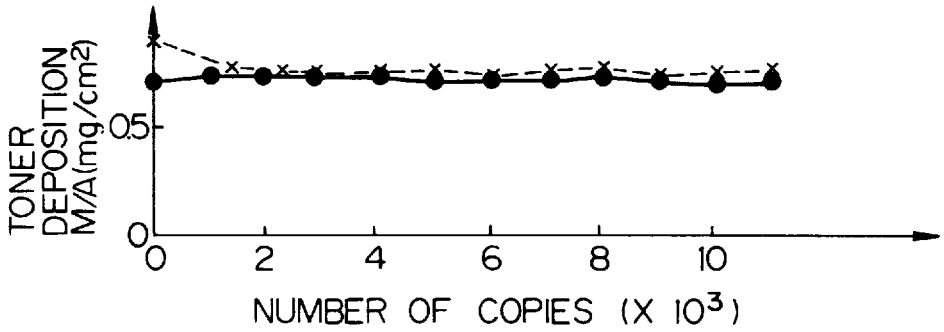
FIG. 6C shows a relation between the number of copies and the amount of toner deposition and also particular to the copier.

In the embodiment, the mean density of the developer is selected to be less than its apparent density, based on JIS Z2504, over the range from substantially the intermediate between the doctor blade 6 and the opening 8*a* to the opening 8*a*, as stated earlier. Alternatively or in addition, the toner concentration of the developer in the chamber 10 may be selected to be less than the saturation toner concentration which is the upper limit allowing the toner to be stably contained in the developer on the sleeve 4. FIGS. 6A–6C respectively show the variation of a toner concentration TC, a variation of a charge Q/M deposited on the toner, and a variation of the amount of toner deposition M/A for development. In FIGS. 6A–6C, dots and crosses are respectively representative of a case wherein the toner concentration is lower than the above saturation concentration and a case wherein it is not lower than the same.

As FIGS. 6A–6C indicate, when the toner concentration of the developer set in the chamber 10 is lower than the saturation concentration, the same amount of charge as in a stabilized condition is reached just after the setting of the developer. This prevents the image density from increasing due to short charge. The toner concentration of the developer to be set in the chamber 10 should preferably be 20% of the the saturation concentration or above. For example, when use is made of a developer providing the saturation toner concentration of 20wt %, it should preferably have a toner concentration of 4% or above, more preferably 10 wt % to 15 wt %. In this condition, the toner concentration of the developer on the sleeve 4 is prevented from decreasing below a preselected lower limit just after it has been set, so that the drum 1 is free from the deposition of the carrier.

Figure 7:
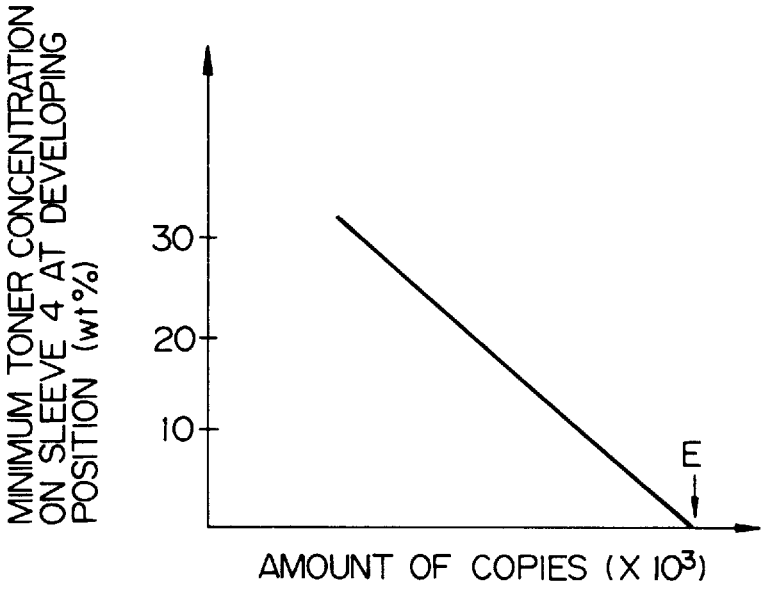
FIG. 7 shows a relation between the amount of carrier contained in a developer and the minimum toner concentration of a developer deposited on a developing sleeve.

In the illustrative embodiment, in the range from substantially the intermediate between the regulating position assigned to the doctor blade 10 and adjoining the chamber 10 and the opening 8*a* to the opening, the developer has a mean density equal to or smaller than its apparent density, as stated earlier. Alternatively or in addition, the developer 3 may be set in the chamber 10 having the volume V in an amount equal to or smaller than the amount of carrier ($Mc=\rho C \cdot V$) as measured by JIS Z2504 when the carrier fills the chamber 10 alone on the basis of the apparent density ($\rho C$) of the carrier. Then, a part of the carrier (5 wt % to 20 wt %) is deposited on the sleeve 4 while the other carrier is packed in the chamber 10 and ready to take in the toner, so that the short image density is obviated. When the developer 3 set in the chamber 10 contains the carrier in substantially the same amount in which the carrier would fill the chamber 10 alone, the toner concentration noticeably falls, as indicated by E in FIG. 7. As a result, even when the image density is short, the flow of the developer 3 for taking in the toner via the opening 8*a* does not occur because the chamber 10 is filled with the developer 3. It follows that the toner concentration is possibly reduced to 0 wt % as the toner consumption proceeds.

3rd Embodiment

Figure 8:
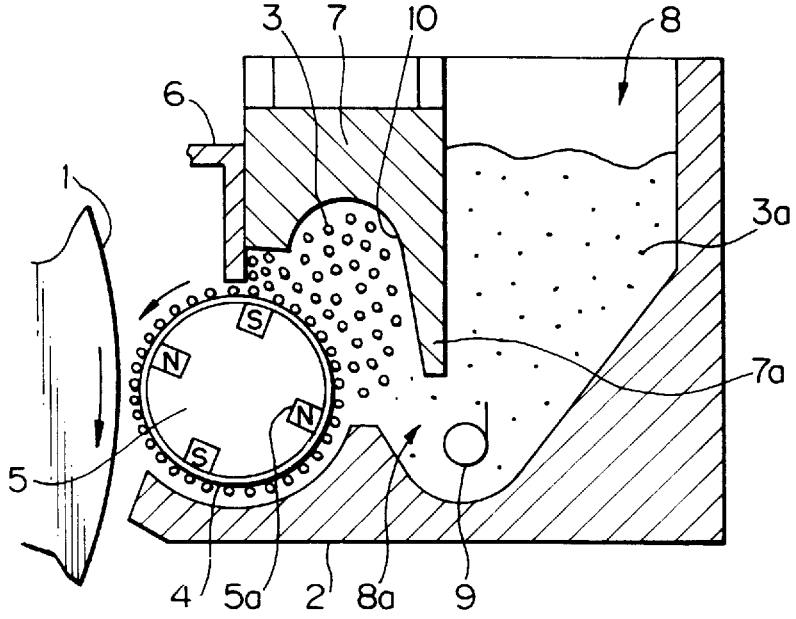
FIG. 8 is a section showing a third embodiment of the present invention.

As shown in FIG. 8, the casing 2 is located at one side of the photoconductive drum 1 and formed with the opening facing the drum 1. The developing sleeve 4 is disposed in the casing 2 and partly exposed to the outside via the opening. The developer consisting of magnetic toner and magnetic carrier is deposited on the surface of the sleeve 4. The magnet member 5 is fixed in place within the sleeve 4 and has a group of stationary magnets. The doctor blade 6 regulates the amount of the developer deposited on the sleeve 4. The hopper 8 stores the fresh toner 3*a* to be replenished. The canopy 7 precedes the doctor blade 6 with respect to the direction of rotation of the sleeve 4 and forms the space for accommodating the developer staying above the sleeve 4.

The edge portion 7*a* extends out from the canopy 7 while being spaced a preselected distance from the sleeve 4. The chamber 10 is formed between the edge portion 7*a* and the sleeve 4 for accommodating the developer scraped off by the doctor blade 6. The pole 5*a* of the magnet 5 is located to face the above chamber 10. The rest of the construction is identical with the embodiment shown in FIG. 2.

In the above configuration, the developer 3 is conveyed by the the sleeve 4 in the direction indicated by the arrow while being regulated by the doctor blade 6 to form a thin layer. The thin layer of the developer 3 reaches the developing position where the sleeve 4 faces the drum 1 rotating in the direction also indicated by an arrow. As a result, the toner of the developer is transferred to the latent image formed on the drum 1, thereby developing it. The developer 3 left on the sleeve 4 without being transferred to the drum 1 is conveyed by the sleeve 4 toward the opening 8*a* of the hopper 8. The fresh toner 3*a* driven out of the hopper 8 via the opening 8*a* by the agitator 9 is taken into the developer at the interface between the developer existing on the sleeve 4 and the developer existing in the chamber 10, as will be described specifically later. Because the developer 3 with the fresh toner has its internal pressure increased by the doctor blade 6, the toner contained in the developer 3 is charged. In this manner, the toner of the developer 3 deposited on the sleeve 4 is charged due to the internal pressure of the developer 3 adjoining the doctor blade 6. This eliminates the need for a complicated mechanism for charging or agitating the developer 3 and including a paddle, screw or the like.

The developer 3 removed by the doctor blade 6 from the sleeve 4 partly moves in the chamber 10 toward the opening 8*a* due to its own internal pressure and gravity. This part of the developer 3 approached the opening 8*a* is circulated toward the doctor blade 6 due to the movement of the developer existing on the sleeve 4, i.e., turns round in the chamber 10.

Figure 9A:
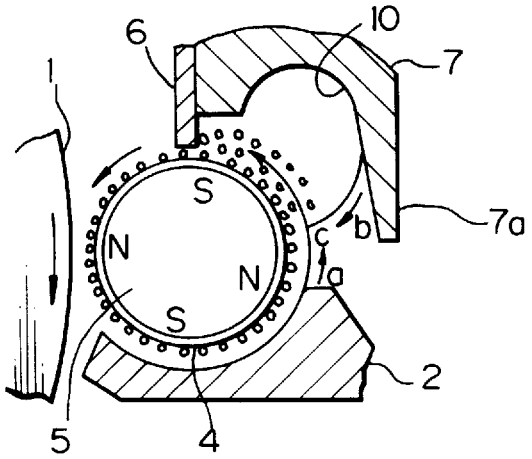
FIGS. 9A–9C demonstrate how toner is taken into carrier in the third embodiment shown in FIG. 8.
Figure 9B:
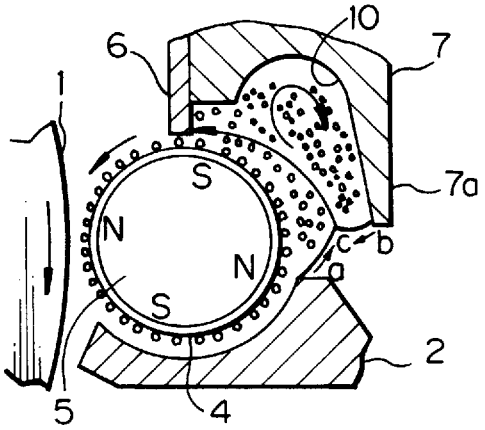
Figure 9C:
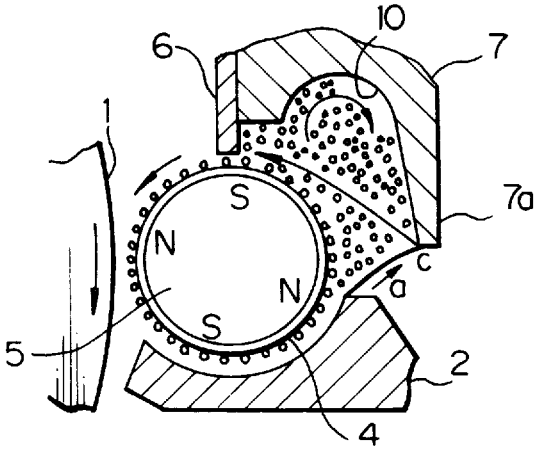

FIGS. 9A–9C demonstrate how toner of different color is taken into the developer 3 turning round in the chamber 10. This was also observed in an enlarged side view through a high-speed video camera operated at a rate of 200 frames/sec and at ten times higher speed. As shown, the developer 3 in the chamber 10 and being conveyed toward the downstream side, i.e., toward the doctor blade 6 is partly directed toward the canopy 7 above the sleeve 4. As a result, this part of the developer 3 turns round in the chamber 10.

As shown in FIG. 9A, the fresh toner come out of the hopper 8 is taken into the developer 3 in the vicinity of a 5 point c where two flows a and b join each other. At this instant, the developer is moving at a rate of about 100 mm/sec in the vicinity of the surface of the sleeve 4. The layer of the developer 3 staying in the chamber 10 turns round at a rate of about 10 mm/sec because a sufficient space is still available in the chamber 10.

As shown in FIG. 9B, the toner concentration of the developer 3 sequentially increases, causing the moving layer of the developer 3 to expand. Then, the point c sequentially moves away from the surface of the sleeve 4. At the same time, the developer flowing in the direction a in the vicinity of the surface of the sleeve 4 is lowered in speed. As a result, the developer 3 moves at a rate of about 65 mm/sec in the vicinity of the sleeve 4 while the layer staying in the chamber 10 turns round at a rate of about 5 mm/sec.

As shown in FIG. 9C, as the amount of toner taken into the developer 3, i.e., the toner concentration of the developer 3 further increases, the volume of the developer 3 also further increases. This sequentially lowers the fluidity of the developer 3 by reducing the space available in the chamber 10. Because the moving layer of the developer sequentially expands, the point c sequentially approaches the inner periphery of the canopy 7. As a result, the fresh toner is not taken into the developer 3 any more. At this time, the layer of the developer staying in the chamber 10 is turning round at a rate of about 1 mm/sec. However, the staying layer in the chamber 10 still has a loose portion in which the toner concentration is higher than the other portion. This part of the staying layer is continuously turning round although its speed is extremely low; the dispersion of the toner into the developer and charging are under way.

The toner is sequentially consumed by repeated development until the toner concentration of the developer in the chamber 10 decreases, so that the volume of the developer 3 decreases. As a result, the condition shown in FIG. 9A is set up again and allows the toner to be introduced into the developer. Not only the toner 3*a* taken into the developer 3 but also the charged toner dispersed in the developer 3 while turning round in the chamber 10 are conveyed to the developing position. Hence, a great amount of charged toner is available for development. Even when the fresh toner is introduced from the hopper 8 into the developer in a great amount, it is dispersed in the developer 3 while turning round in the chamber 10. This toner and the toner already charged in the chamber 10 are conveyed to the developing position. Therefore, the embodiment is free from the occurrence that the short charge of toner causes the toner to contaminate the background or to fly about, as discussed in relation to Japanese Patent Publication No. 5-67233 previously.

When the toner concentration of the developer 3 decreases, the volume of the developer 3 decreases and does not stop up the opening 8*a*. Consequently, the toner is replenished into the developer on the sleeve 4 in a preselected amount, maintaining the toner concentration of the developer 3 above preselected one. In this manner, the upper limit of toner concentration is controlled. This eliminates the need for a complicated toner concentration control mechanism relying on a toner concentration sensor and a toner replenishing member.

Figure 10:
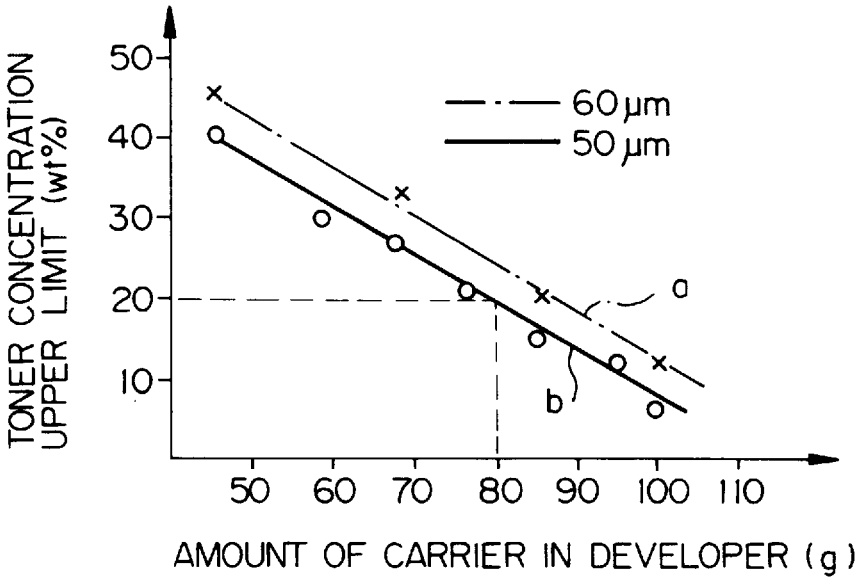
FIG. 10 shows the relation between the amount of magnetic carrier contained in the developer existing in a developer storing chamber and the upper limit of toner concentration taken in the toner, and achievable with the third embodiment.

FIG. 10 shows the relation between the amount of carrier of the developer to be stored in the chamber 10 and the upper limit of the amount of toner to be taken into the carrier, and available with the embodiment. In FIG. 10, a line a shows a case wherein the carrier has a particle size of 50 $\mu$m while a line b shows a case wherein it has a particle size of 60 $\mu$m. As curves a and b indicate, the amount of toner to be taken into the developer depends on the particle size of the carrier, and a desired toner concentration is achievable on the basis of the amount of carrier to be stored in the chamber 10. Specifically, assume that use is made of a carrier having a particle size of 60 $\mu$m, and that the upper limit of toner concentration should be controlled to 20 wt %. Then, it will suffice to store 80 g of carrier in the chamber 10 beforehand.

Figure 11:
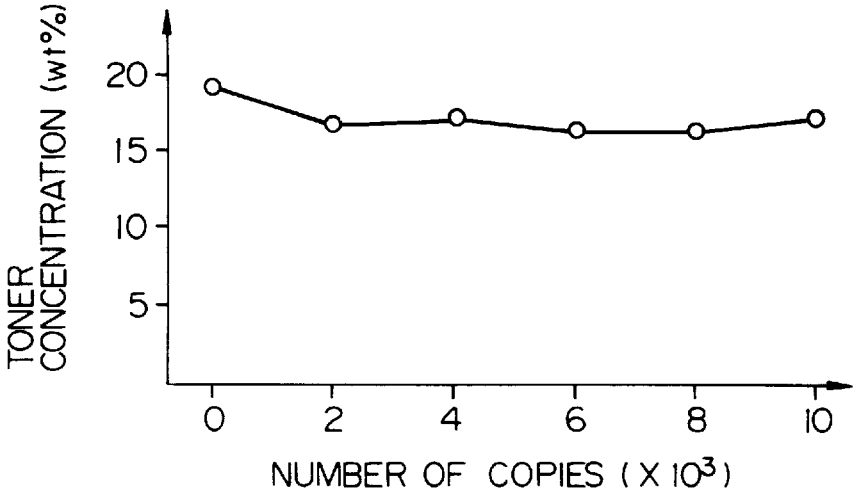
FIG. 11 shows the relation between the upper limit of toner concentration of the developer in the developer storing chamber and the number of copies and also achievable with the third embodiment.

FIG. 11 shows a relation between the toner concentration and the number of copies and determined when the above embodiment was operated to perform 10,000 consecutive times of development with a carrier having a particle size of 50 $\mu$m. It will be seen that the embodiment automatically controls the toner concentration to substantially 20 wt % at all times without resorting to agitating means or similar special means for adjustment.

As stated above, because the developer turns round in the chamber 10, an occurrence that only the developer layer adjoining the sleeve 4 frequently contributes to development, as in the conventional device, is obviated. Hence, the life of the developer is extended. Because the developer in the chamber 10 has a constant toner concentration, the resulting image quality is extremely stable. In addition, because the toner is sufficiently charged when the developer turns round in the chamber 10, the embodiment is fully adaptive even to a high-speed matching needing a great amount of developer.

Figure 12:
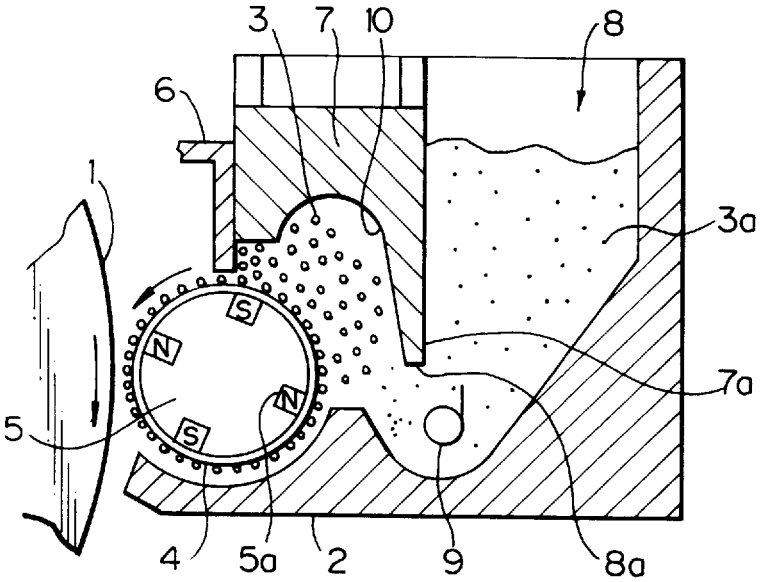
FIG. 12 is a sectional views showing a modification of the third embodiment.

As shown in FIG. 12, the canopy 7 of this embodiment should preferably have its edge portion 7*a* extended downward below the free edge of the doctor blade 6. In this configuration, even when the developer 3 removed from the sleeve 4 by the blade 6 is returned toward the canopy edge 7*a*, the edge 7*a* receives it and surely confines it in the range in which the force of the magnet 5 acts.

In FIG. 12, the magnet 5*a* having a pole P3 is positioned upstream of the opening 8*a* in the direction of rotation of the sleeve 4. The magnet 5*a* should preferably have a flux density great enough for a magnet brush formed on the sleeve 4 to pressingly contact the casing 2. Such a magnet brush fills the space between the sleeve 4 and the casing 2 and surely prevents the toner from dropping or flying about via the opening 8*a* toward the upstream side.

In the illustrative embodiment use is made of toner having a particle size of 7.5 $\mu$m and magnetite carrier having a particle size of 50 $\mu$m or 60 $\mu$m. Although a nonmagnetic toner behaves in the same manner as the magnetic toner, the magnetic toner is advantageous over the nonmagnetic toner in that its behavior can be confined in the coverage of the force of the magnet member 5, i.e., a minimum of toner is allowed to fly about. For the magnetic toner, the toner used in the first embodiment may also be used.

4th Embodiment

Figure 13:
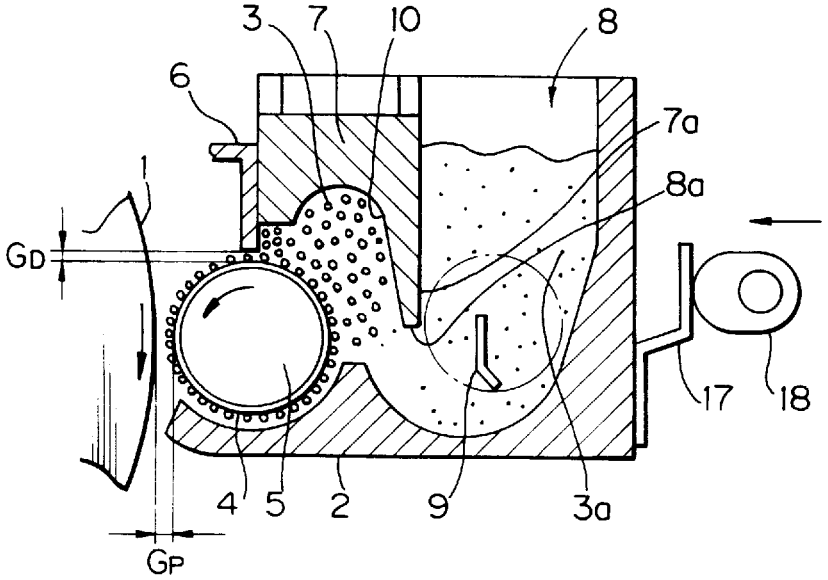
FIG. 13 is a section showing a fourth embodiment of the present invention.

Referring to FIG. 13, a fourth embodiment of the present invention is shown. As shown, the casing 2 is located at one side of the photoconductive drum 1 and formed with the opening facing the drum 1. The developing sleeve 4 is disposed in the casing 2and partly exposed to the outside via the opening. The developer consisting of magnetic toner and magnetic carrier is deposited on the surface of the sleeve 4. The magnet member 5 is fixed in place within the sleeve 4 and has a group of stationary magnets. The doctor blade 6 regulates the amount of the developer deposited on the sleeve 4. The hopper 8 stores the fresh toner 3*a* to be replenished. The canopy 7 precedes the blade 6 with respect to the direction of rotation of the sleeve 4 and forms the space for accommodating the developer staying above the sleeve 4.

The edge portion 7*a* extends out from the canopy 7 while being spaced a preselected distance from the sleeve 4. The chamber 10 is formed between the edge portion 7*a* and the sleeve 4 for accommodating the developer scraped off by the blade 6. The pole 5*a* of the magnet 5 is located to face the above chamber 10. The agitator 9 is disposed in the space adjoining the opening 8*a*.

In the above configuration, the developer 3 is conveyed by the sleeve 4 in the direction indicated by the arrow while being regulated by the blade 6 to form a thin layer. The thin layer of the developer 3 reaches the developing position where the sleeve 4 faces the drum 1 rotating in the direction also indicated by an arrow. As a result, the toner of the developer is transferred to the latent image formed on the drum 1, thereby developing it. The developer 3 left on the sleeve 4 without being transferred to the drum 1 is conveyed by the sleeve 4 toward the opening 8*a*. The fresh toner 3*a* driven out of the hopper 8 via the opening 8*a* by the agitator 9 is taken into the developer at the interface between the developer existing on the sleeve 4 and the developer existing in the chamber 10. Because the developer 3 with the fresh toner has its internal pressure increased by the doctor blade 6, the toner contained in the developer 3 is charged. In this manner, the toner of the developer 3 deposited on the sleeve 4 is charged due to the internal pressure of the developer 3 adjoining the doctor blade 6. This eliminates the need for a complicated mechanism for charging or agitating the developer 3 and including a paddle, screw or the like.

The developer 3 removed by the blade 6 is partly moved toward the opening 8*a* of the hopper 8 in the chamber 10 due to its own internal pressure and gravity. The developer 3 approached the opening 8*a* is circulated toward the doctor 6 due to the rotation of the sleeve 4.

Figure 14:
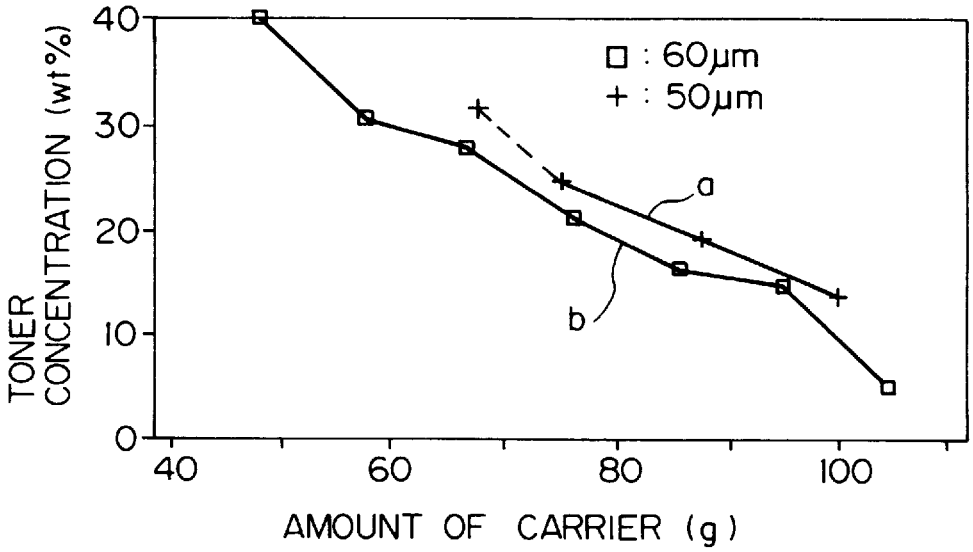
FIG. 14 shows a relation between the amount of carrier contained in the developer and the upper limit of toner concentration.

FIG. 14 shows a relation between the amount of carrier set in the chamber 10 and the upper limit of toner concentration TC. In FIG. 14, curves a and b respectively show a case wherein the carrier has a particle size of 50 μm and a case wherein wherein it has a particle size of 60 μm. As FIG. 14 indicates, even when the same amount of carrier is set in the chamber 10, the toner concentration depends on the particle size of the carrier. Therefore, a method for determining the upper limit of toner concentration in consideration of, e.g., the particle size of the carrier is needed.

A series of researches and experiments showed that images free from background contamination and local omission are achievable if a toner concentration at which the previously discussed carrier covering ratio decreases below 100% is determined to be the upper limit. To produce a carrier covering ratio Tn, use is made of the following equation:

$$Tn = (\text{sum of areas occupied by } n \text{ toner particles/surface area of single carrier particle}) \times 100 \quad \text{Eq. (4)}$$

Because the area occupied by a single toner particle is $2(\sqrt{3})r^2$ and because the surface area of a single carrier is $4\pi(R+r)^2$, the carrier covering ratio Tn is expressed as:

$$Tn = \frac{2\sqrt{3}\ r^2 n}{4\pi(r+R)^2} \times 100 \quad \text{Eq. (5)}$$

Figure 15A:
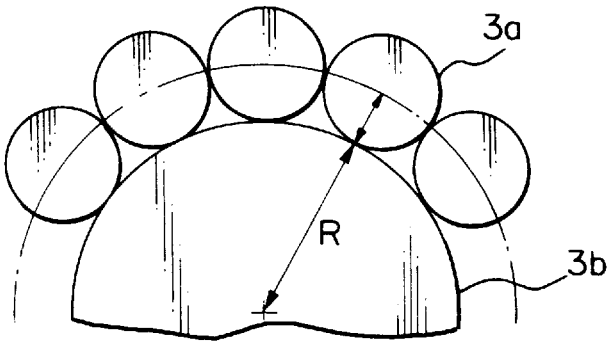
FIGS. 15A and 15B show planar approximate models used to produce an equation for determining a carrier covering ratio.
Figure 15B:
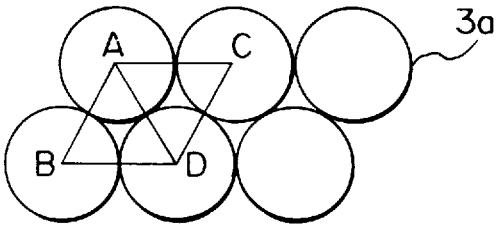

The toner concentration (wt %) is produced by (weight of toner)/(weight of toner+weight of carrier)×100. As shown in FIGS. 15A and 15B, for the sake of universality, assume that carrier particles 3*b* and a toner particle 3*a* are spherical each, and that the carrier covering ratio is 100% when n toner particles fully cover the surface of a single carrier particle in a single layer. Let the n toner particles fully covering the surface of a single carrier particle be referred to as a limit number of toners. While the covering ratio may be calculated by planar approximation or spherical approximation proposed in the past, the embodiment uses planar approximation in the practical range of the practical ratio between the radius of the toner and that of the carrier.

Specifically, as shown in FIG. 15A, assume that the toner particles 3*a* and carrier particle 3*b* have radii r and R, respectively. As shown in FIG. 15B, the surface area of a sphere having a radius (r+R) is divided by the area of a parallelogram ABCD which is substantially a single occupied area, thereby producing the limit number of toners N. Then, N is produced by:

$$N = \frac{4\pi(r+R)^3}{2\sqrt{3}\ r^2} \quad \text{Eq. (6)}$$

It is to be noted that with the above approximation, a condition of R>>r is essential which allows the surface of the carrier 3*b* to be regarded as a plane as seen from the toner 3*a*.

A single carrier particle and a single toner particle have weights respectively produced by $4\pi R^3 pc/3$ and $4R^3 pt/3$. Hence, the toner concentration C (wt %) of the developer may be expressed in terms of the number of toners n as:

$$C = \frac{100 n r^3 \rho_t}{n r^3 \rho_t + R^3 \rho_c} \quad \text{Eq. (7)}$$

where r is the radius of the toner particle (μm), pt is the true specific gravity of the toner (g/cm$^3$), and pc is the true specific gravity of the carrier (g/cm$^3$).

By deleting n in the Eqs. (5) and (7), there is obtained:

$$Tn = \frac{100C\sqrt{3}}{2\pi(100-C)\cdot(1+r/R)^2\cdot(r/R)\cdot(\rho_t/\rho_c)} \quad \text{Eq. (8)}$$

Figure 16A:
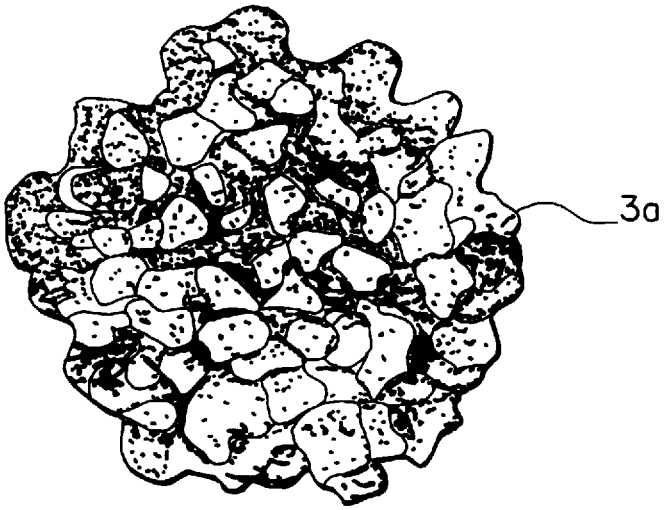
FIGS. 16A and 16B respectively show the deposition of toner on carrier to occur when the carrier covering ratio is 100% and when it is 169%.
Figure 16B:
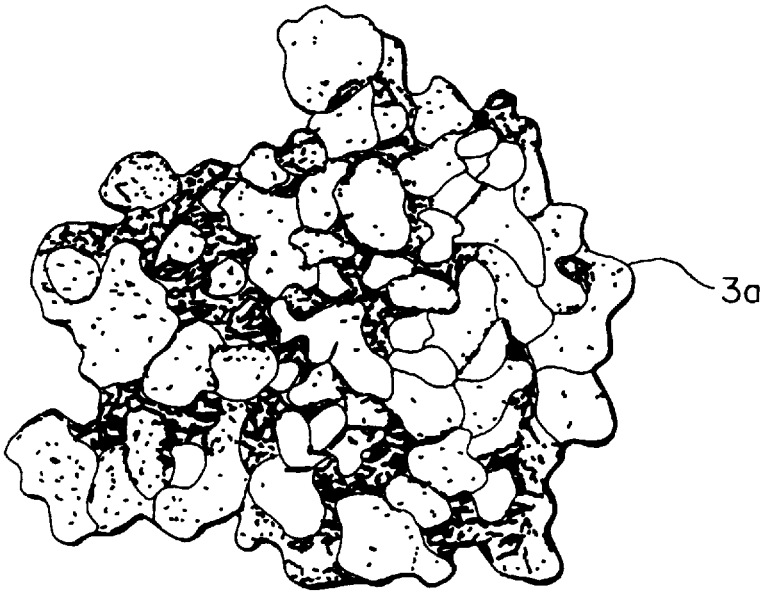

FIG. 16A is a sketch showing how the toner 3*a* deposits on the carrier when the toner concentration of the developer corresponds to the carrier covering ratio of 100%. As shown, the toner 3*a* deposits on the carrier without any clearance. As shown in FIG. 16B, when the covering ratio is 169%, the toner 3*a* covers the carrier in multiple layers. In this manner, when the covering ratio is 100% or above, the toner 3*a* fully covers the surface of the carrier, as determined by experiments.

Now, when the developer with the carrier covering ratio of 100% or above enters the chamber 10, its particles repeatedly rub each other. The toner is charged by friction acting between it and the carrier. However, when the covering ratio of the carrier is 100% or above, the toner covers the toner existing on the carrier because the carrier is not exposed to the outside. As a result, friction acting between the toner particles causes some of them to be charged to the positive polarity and the others to be charged to the negative polarity. Assume that friction acting between the carrier and the toner deposits negative charge on the toner. Then, the toner particles charged to the positive polarity due to friction therebetween fail to deposit on the latent image and contaminate the background.

As stated above, the embodiment determines the toner concentration in which the carrier covering ratio does not exceed 100% to be the upper limit of toner concentration. The developer is set in the chamber 10 with an amount of carrier realizing the upper limit, thereby obviating defects including background contamination.

Further, as shown in FIG. 13, a leaf spring 17 is affixed to the casing 2 in order to bias the developing device toward the drum 1. As a result, the gap between the drum 1 and the sleeve 4 is adjusted by the leaf spring 17. Further, a cam 18 presses the leaf spring 17. When the cam 18 presses the developing device in the direction indicated by an arrow via the spring 17, the sleeve 7 carrying the developer in a layer regulated to a thickness GD by the blade 6 is pressed against the surface of the drum 1. Hence, a gap GP for development is automatically controlled by the thickness GD of the developer 3.

We found that when the developer 3 on the sleeve 4 consists of the carrier and toner, a desirable image is achievable if the upper limit of toner concentration is so determined as to set up a carrier covering ratio between 60% and 100% in the Eq. (2) or (5). If the developer is used in this range, the probability that the carrier scratches or otherwise damage the surface of the drum 1 is reduced, compared to the case wherein the carrier covering ratio is lower than 60%. The damage to the drum 1 would cause the local omission of a solid image and other defects to occur. Further, background contamination is reduced, compared to the case wherein the covering ratio is 100% or above.

For example, when the covering ratio is 100%, the toner covers the surface of a single carrier in a single layer. Hence, even if the developer on the sleeve 4 is pressed against the drum 1, the carrier does not directly contact the drum 1 or damage it. Experiments showed that when the covering ratio is 60% or above, the probability that the carrier damages the drum 1 is extremely low. For the magnetic carrier, use may be made of iron powder or ferrite-based magnetite. The carrier configuration may be amorphous or spherical. For the experiments, use was made of a magnetic carrier having a specific gravity of 5.2 g/cm$^3$ and a particle size of 50 μm, and a magnetic carrier having a specific gravity of 1.84 g/cm$^3$ and a particle size of 7.5 $\mu$m.

Generally, when a magnetic toner is used, a carrier covering ratio of 60% or above reduces the amount of charge to deposit on the toner and finally causes the toner to fly about and contaminate the background. It is generally accepted that the carrier covering ratio should preferably be 25% or below in order to obviate the above occurrence. However, the magnetic toner is attracted toward the sleeve 4 due to the force of the pole of the stationary magnet member 5. Hence, even when the charge of the toner is reduced due to an increase in covering ratio, the toner flies about little and sparingly contaminates the background, compared to a nonmagnetic toner.

5th Embodiment

Figure 17:
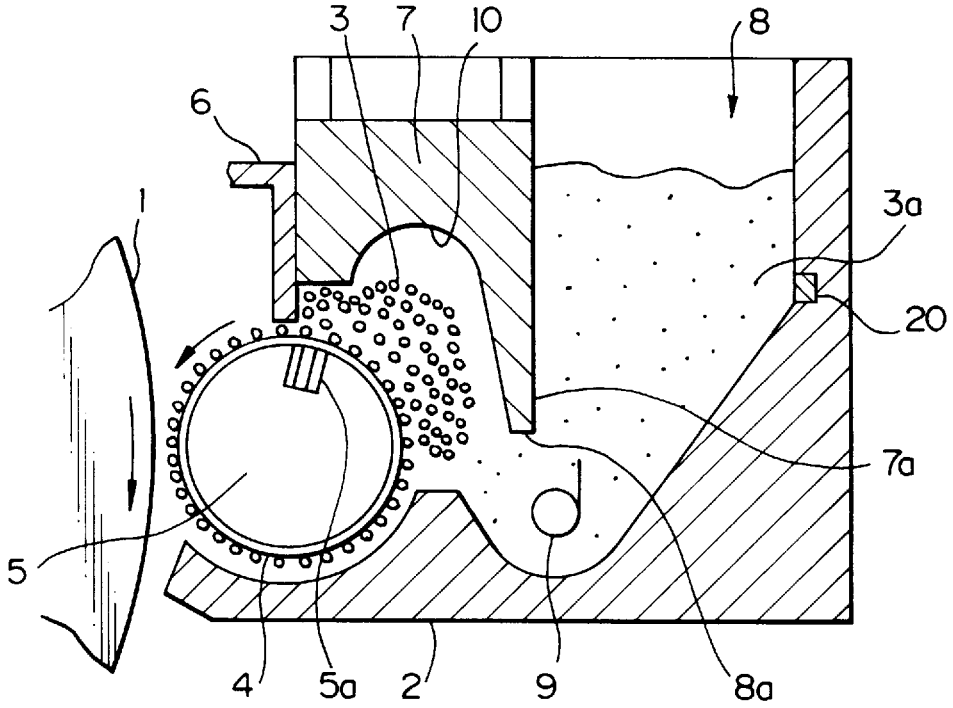
FIG. 17 is a section showing a fifth embodiment of the present invention.

FIG. 17 shows a fifth embodiment of the present invention similar to the second embodiment except that a sensor 20 responsive to the amount of toner remaining in the hopper 8 is mounted on the wall of the hopper 8. Also, this embodiment is identical with the second embodiment as to the behavior of the developer in the chamber 10.

The sensor 20 senses the amount of the toner remaining in the hopper 8 in contact with the toner and may be implemented by a relatively inexpensive piezoelectric oscillator. The sensor 20 is positioned at a level slightly higher than the uppermost level at which the carrier and toner can contact each other. In this position, the sensor 20 is capable of determining that the amount of the toner in the hopper 8 is short, when it is still great enough to be taken into the developer 3.

The developer in the chamber 10 is circulated therein, as stated in relation to the second embodiment. This reduces the deterioration of the developer 3, compared to the device which does not circulate it. In addition, even when the hopper 8 runs out of the toner, the developer is still serviceable, compared to a developer for use in the conventional device.

When the top of the toner 3*a* in the hopper 8 is lowered to the level of the sensor 20, the sensor 20 senses it and determines that the amount of the toner remaining in the hopper 8 is short. The sensor 20 senses the remaining amount in the condition wherein the toner is present at the uppermost portion of the interface where the toner contacts the developer 3. Hence, even when the remaining amount of toner reaches the sensing level, the sensor 20 senses it in the condition wherein the toner can be surely replenished into the developer 3. When the toner in the hopper 8 is short as determined by the sensor 20, display means, not shown, urges the operator to supply fresh toner into the hopper 8. This prevents the image quality from critically lowering and protects the drum 1 from the deposition of the carrier. The toner supplied to the hopper 8 by the operator allows the developer still maintaining its acceptable characteristic to be continuously used without being replaced.

As stated above, the developer 3 has an acceptable characteristic even when the toner in the hopper 8 has been consumed from its full level to the short level. The embodiment allows toner to be surely supplied to the hopper 8 at the toner level which the sensor 20 determines to be short. Hence, the developer 3 can be continuously used. In addition, there are obviated a decrease in image density and the deposition of the carrier on the drum 1.

Figure 18:
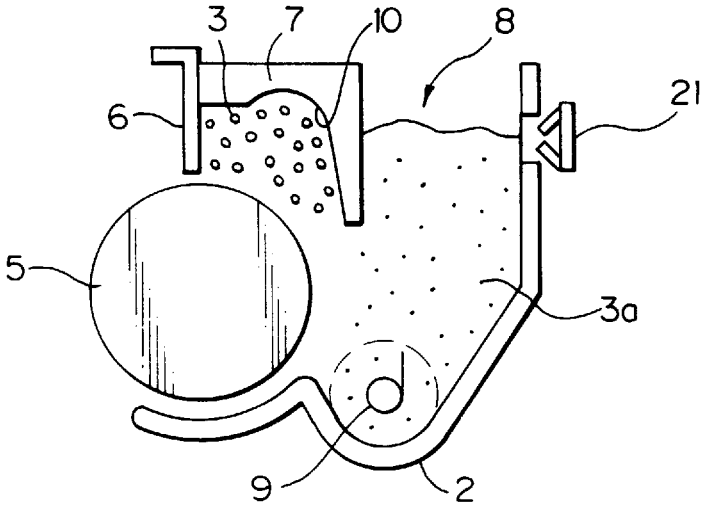
FIG. 18 is a section showing a modification of the fifth embodiment.

As shown in FIG. 18, the sensor 20 mounted on the wall of the hopper 8 may be replaced with, e.g., an optical sensor 21. In FIG. 18, a transparent member constitutes a part of the hopper 8 corresponding to the short toner level. The optical sensor 21 is positioned outside of the hopper 8 in such a manner as to sense the toner 3*a* through the transparent member, i.e., without contacting the toner. More specifically, a conventional inexpensive sensor can be mounted on the body of the developing device spaced from the hopper 8. This simplifies the device and reduces the cost of the device due to the omission of wirings for connectors.

Figure 19A:
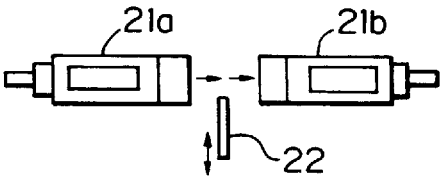
FIGS. 19A–19C each shows a specific configuration of a sensor included in the fifth embodiment.
Figure 19B:
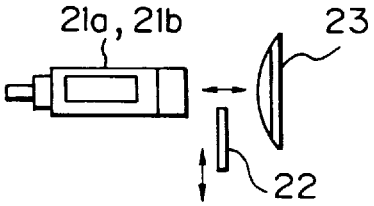
Figure 19C:
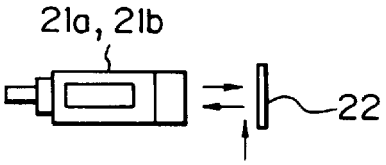

FIGS. 19A–19C each shows a particular configuration of the optical sensor 21. In FIG. 19A, the sensor 21 is of transmission type and made up of a light emitting device 21*a* and a light-sensitive device 21*b* facing each other. A shield member 22 intercepts the light issuing from the device 21*a* to thereby produce a control output. In FIG. 19B, the sensor 21 is of recursive reflection type and produces a control output by causing light to reciprocate via a recursive reflector 23; a subject 22 to be sensed intercepts the optical path. Basically, the recursive type sensor 21, like the transmission type sensor 21, detects the interruption of the optical coupling. In FIG. 19C, the sensor 21 is of diffused reflection type and operates on the basis of the reflection from the surface of the subject 22 itself.

Figure 20:
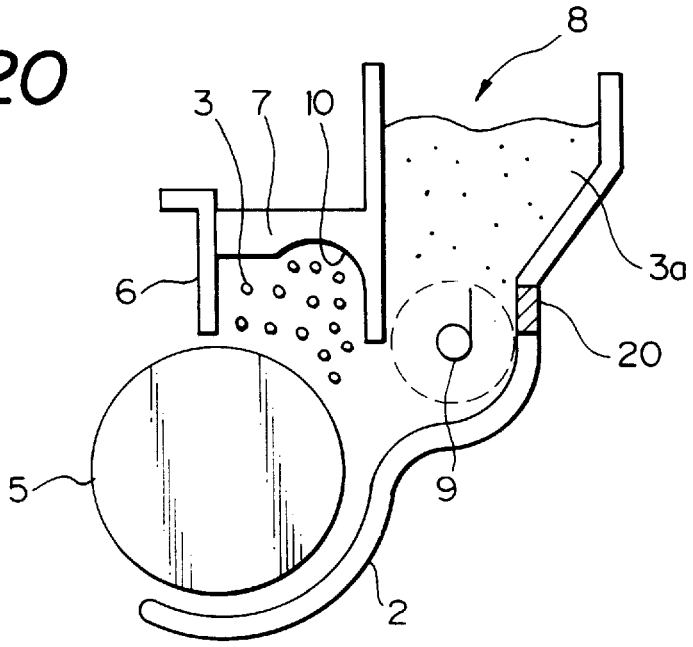
FIGS. 20 and 21 are sectional views each showing another modification of the fifth embodiment.

FIG. 20 shows a modification in which the agitator 9 is located at a higher level than in FIG. 17. As shown, the sensor 20 is positioned such that at least the bottom of the locus of rotation of the agitator 9 is located in the portion where the toner stays. This also achieves the above advantages. In addition, even just before the sensor 20 determines that the amount of the toner remaining in the hopper 8 is short, the toner can be surely fed to the sleeve 4 by the rotation of the agitator 9.

Figure 21:
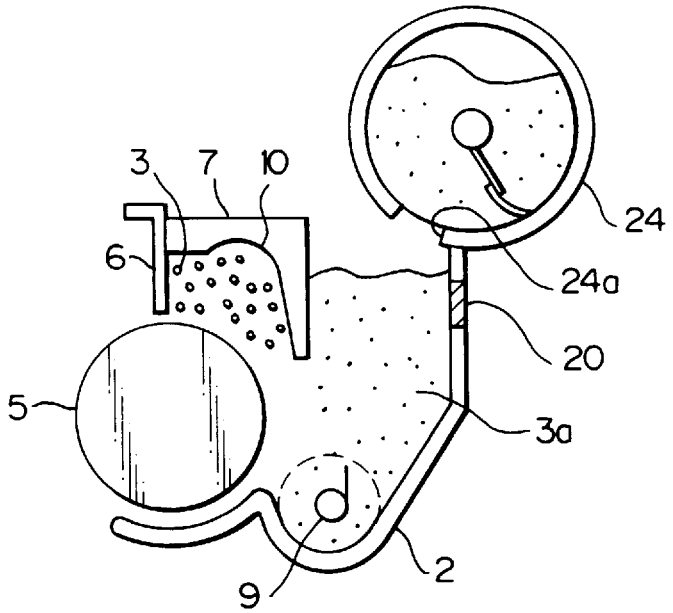

As shown in FIG. 21, this embodiment is similarly practicable with a toner bottle 24. In this case, the sensor 20 must be positioned at a level lower than a toner outlet 24*a* formed in the bottle 24, but slightly higher than the highest position where the toner and carrier can contact each other. In this configuration, even when the sensor 20 determines that the toner in the hopper 8 is short, toner can be supplied to the hopper 8 via the outlet 24*a* of the bottle 24. This frees the operator from the frequent supply of toner into the hopper 8. Moreover, the bottle 24 is bodily removable from the body of the developing device, and therefore easy to replace.

6th Embodiment

Figure 22:
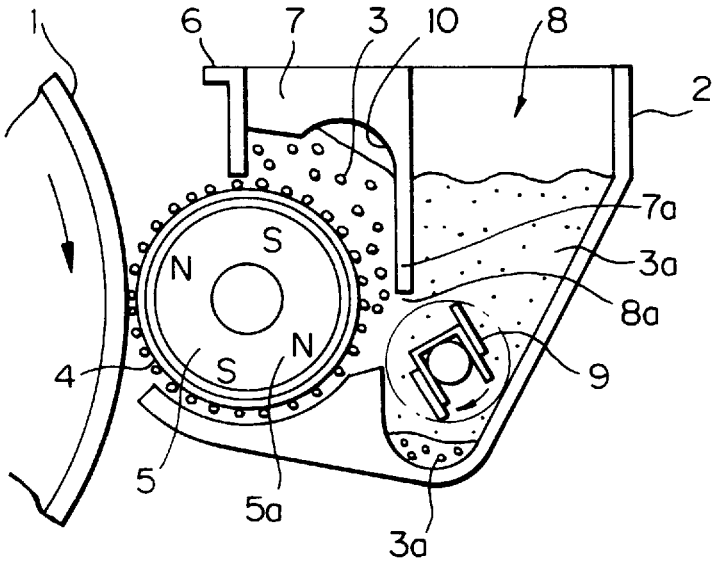
FIG. 22 is a sectional views showing a sixth embodiment of the present invention.
Figure 23A:
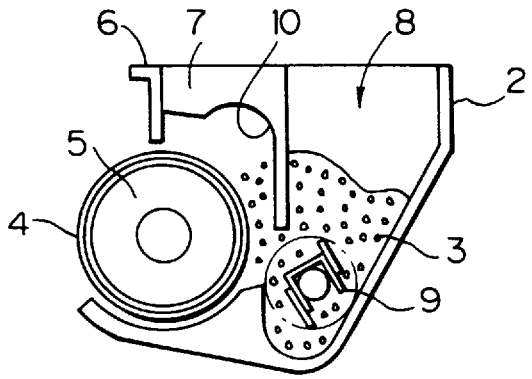
FIGS. 23A–23C demonstrate how toner is taken into the developer in the sixth embodiment.
Figure 23B:
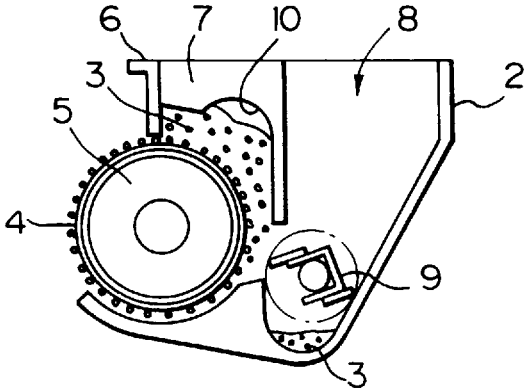
Figure 23C:
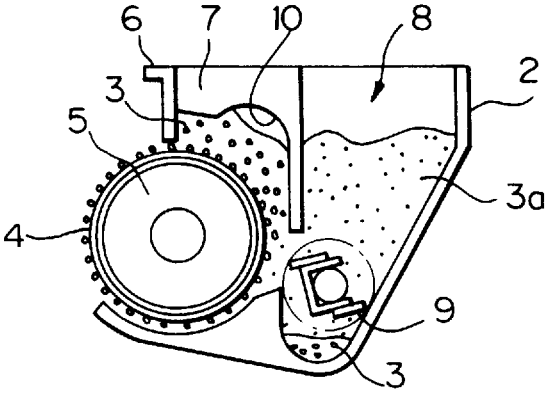

FIG. 22 shows a sixth embodiment of the present invention also similar to the second embodiment of FIG. 2 except for the following. FIGS. 23A–23C demonstrate how the developing device of this embodiment is loaded with the developer. First, as shown in FIG. 23A, the developer 3 having a desired toner concentration (20 wt % in the embodiment) is set in the toner hopper 8 and space 10, as well as the other spaces, up to an amount which the sleeve 4 is assumed to fail to carry with its magnetic force. The sleeve 4 is rotated by hand, by the copier body or by exclusive drive means included in the device body. When the developer is conveyed to the range in which the magnet roller 5 attracts it toward the sleeve 4, the chamber 10 is sequentially filled with the developer 3. At the time when the sleeve 4 fails to retain the developer 3 with its magnetic force, the developer 3 cannot be attracted toward the sleeve 4 despite the rotation of the agitator 9. This, coupled with the fact that the developer 3 scarcely contacts the agitator 9, causes the developer 3 to move in the axial direction of the sleeve 4 and thereby uniformly distributes it. More specifically, assume that the developer 3 is at least initially set in an amount greater than the amount which the sleeve 4 can retain by magnetism. Then, even if the developer 3 is set slightly unevenly in the axial direction of the sleeve 4, the above procedure allows it to be substantially evenly distributed in the axial direction in the amount which the sleeve 4 can retain by the magnetic force.

For a given initial toner concentration of the developer 3, there is a tendency that the toner concentrations remains the same throughout the axial direction of the sleeve 4 if the developer 3 is uniformly distributed in the above direction. This obviates the irregular distribution of toner concentration.

As shown in FIG. 23B, the part of the developer 3 which the sleeve 4 has failed to carry with with magnetic force is prevented from remaining in the locus of rotation of the agitator 9. Specifically, the excess developer 3 is caused to stay on the bottom of the hopper 8 which the bottom of the above locus does not reach. When a shutter, for example, is positioned in the opening 8*a* in order to prevent the developer from flowing reversely from the chamber 10 to the hopper 8, the developing device may be bodily turned upside down. Then, the developer 3 staying in the above portion will drop due to gravity to be removed thereby. After the developer 3 has been uniformly distributed in the axial direction of the sleeve 4, toner is introduced into the hopper 8, as shown in FIG. 23C.

Figure 24:
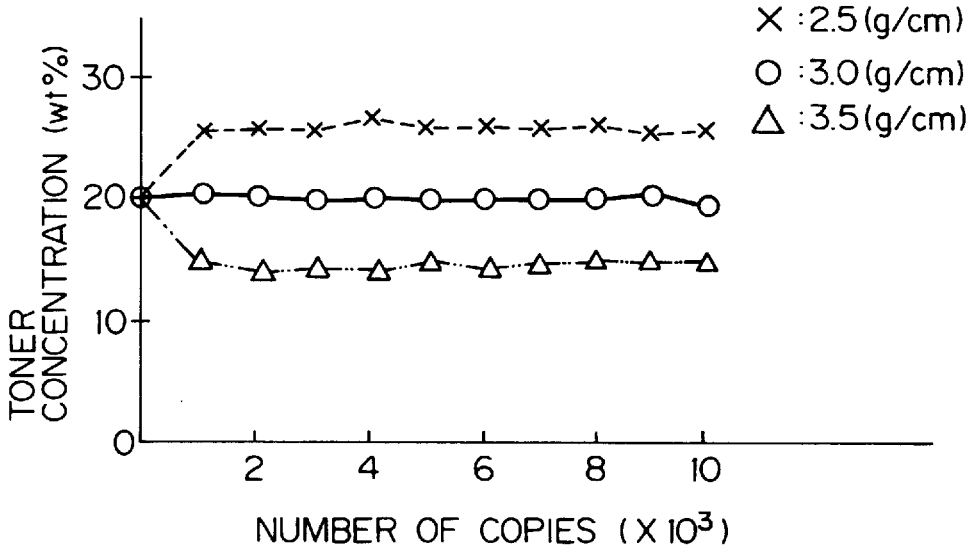
FIG. 24 is a graph showing the relation between the number of copies and the toner concentration with respect to the sixth embodiment.

FIG. 24 shows a relation between the number of copies produced after the developer has been initially set, as stated above, and the toner concentration of the developer 23. The relation was determined by varying the maximum amount o f developer Wmax (g/cm) which the sleeve 4 can retain thereon with the magnetic force, ie., the maximum amount for a unit length in the axial direction. In this case, after the maximum amount Wmax of developer has been magnetically deposited on the sleeve 4, the toner is sealed in the hopper 8. Then, the developing device is mounted to the copier. In FIG. 24, a curve with crosses, a curve with circles and a curve with triangles are respectively representative of a case wherein Wmax is 2.5 g/cm, a case wherein it is 3.0 g/cm, and a case wherein it is 3.5 g/cm.

As FIG. 24 indicates, the initially set toner concentration of the developer is substantially maintained despite repeated development. When the developer is set in an amount smaller than Wmax, the toner concentration settles at a level higher than the initially set toner concentration. Conversely, when the developer is set in an amount greater than Wmax, and if the excess developer which cannot be retained by the magnetic force of the sleeve 4 is allowed to exist in the range of rotation of the agitator 9, the toner concentration settles at a level lower than the initially set toner concentration. Therefore, if the initially set toner concentration is ±30% of the mean toner concentration to be set up during regular development, an image developed just after the initial setting of the developer will be comparable with an image developed in a regular or steady condition.

The magnetic field distribution of the magnets disposed in the sleeve 4 and the magnetic characteristic of the developer may each be controlled to a preselected range in order to relatively stabilize the amount in which the developer can be magnetically retained on the sleeve 4. In the illustrative embodiment, the flux density of the electric field formed on the sleeve 4 by the magnet roller 5 is selected to be 80 mT to 100 mT. For example, if the magnetizing strength is controlled within ±10%, if the magnetization arrangement is controlled within ±3 degrees, and if the permeability of the developer is controlled within ±10%, then it is possible to regulate the irregularity in the amount of the developer to be magnetically retained on the sleeve 4 within about ±5%. In light of this, the developer is set in the developing device via the hopper 8 in a mean amount Zmax (g) of the limit amounts which can be magnetically retained on the sleeve 4. Subsequently, the sleeve 4 and agitator 9 are rotated, e.g., by hand so as to cause the developer to move back and forth several consecutive times along the axis of the sleeve 4. As a result, the developer is easily set on the sleeve 4 in a uniform condition. Particularly, this embodiment facilitates the manual operation because it is light weight due to the relatively small amount of developer and the absence of an inclined fin or screw for driving the developer.

Figure 25:
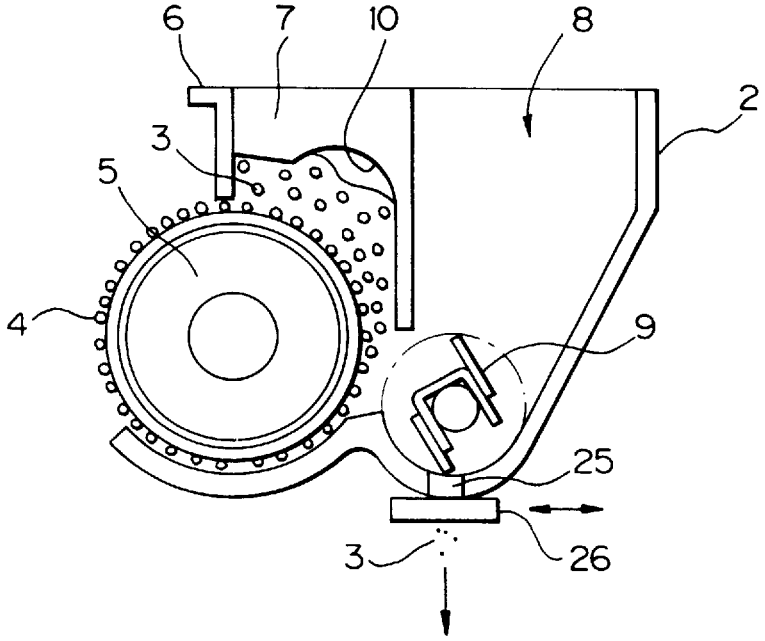
FIG. 25 is a section showing a modification of the sixth embodiment.

FIG. 25 shows a modification of the above embodiment. As shown, the hopper 8 has an opening 25 in its bottom for discharging the excess developer. A shutter 26 selectively opens or closes the opening 25. When the developer 3 is retained on the sleeve 4, the excess developer is discharged through the opening 25. Specifically, after the shutter 26 has been opened in the direction indicated by a double-headed arrow, the agitator 9 is rotated to discharge the excess developer through the opening 25. Thereafter, the shutter 26 is closed, and then toner is introduced into the hopper 8. This prevents the excess developer 3 to be delivered to the chamber 10 and thereby obviates the irregular toner concentration ascribable to the varying amount of the developer.

7th Embodiment

Figure 26:
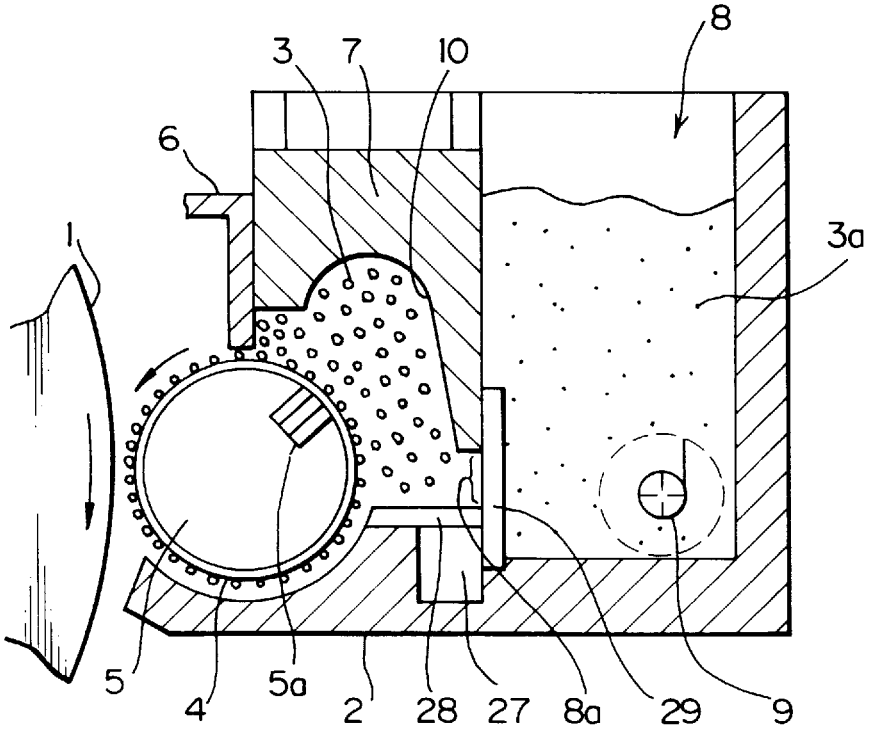
FIG. 26 is a section showing a seventh embodiment of the present invention.

FIG. 26 shows a seventh embodiment of the present invention also similar to the second embodiment except for the following. As shown, the agitator 9 has the axis of its rotation and the length of its blade adjusted such that the outermost locus of rotation does not contact the developer 3, as indicated by a dashed line in FIG. 26. A bore 27 is formed in the bottom of the casing 2 at a position where the magnetic force of the pole 5*a* does not act. The excess developer failed to deposit on the sleeve 4 drops into the bore 27.

In operation, when the sleeve 4 is rotated in the direction indicated by an arrow, the developer 3 deposited thereon is conveyed toward the doctor blade 6 and regulated in thickness thereby. The resulting thin developer layer is brought to the developing position where the sleeve 4 faces the drum 1. At the developing position, the toner is fed to the latent image formed on the drum 1 in or out of contact with the drum 1. The unused developer 3 is conveyed by the sleeve 4 toward the opening 8*a*. The fresh toner 3*a* driven out of the hopper 8 by the agitator 8 is taken into the developer via the opening 8*a*. The developer with the fresh developer 3*a* is returned to the chamber 10. This developer 3 has its internal pressure increased by the doctor blade 6 with the result that the toner is charged by friction. In this manner, the toner of the developer 3 on the sleeve 4 is charged by the internal pressure of the developer existing in the chamber 10. This eliminates the need for a complicated agitating and conveying mechanism including a paddle or a screw.

The part of the developer 3 removed from the sleeve 4 by the blade 6 moves in the chamber 10 toward the opening 8*a* due to its internal pressure and gravity. The developer 3 approached the opening 8*a* is attracted toward the sleeve 4 due to the force of the pole 5*a*. As a result, the developer 3 is again conveyed toward the doctor 6 by the sleeve 4 and circulated in the chamber 10 thereby.

When the toner taken into the developer 3, i.e., the toner concentration of the developer 3 increases, the volume of the developer 3 increases. As a result, the developer 3 expands as far as the opening 8*a* and covers it and thereby reduces the amount in which the toner is to be taken into the developer 3 on the sleeve 4. In this manner, the toner concentration of the developer 3 is maintained below a preselected value at all times. Conversely, when the toner concentration of the developer 3 decreases, the volume of the developer 3 also decreases and uncovers the opening 8*a*. Consequently, the toner is taken into the developer 3 in a preselected amount, thereby maintaining the toner concentration of the developer 3 above a preselected value at all times.

How the above developing device is handled before it is used for the first time is as follows. The developing device delivered from a factory to a customer is held in the condition illustrated in FIG. 26. As shown, the bore 27 is closed by a shutter or seal member 28. The opening 8*a* is also closed by a shutter or partitioning member 29. The initial developer is stored in the chamber 10 and has a toner concentration substantially equal to the optimal toner concentration controlled such that desirable developed images are achievable during development. The amount of the developer in the chamber 10 is greater than the amount which can be retained on the sleeve 4 by the force of the pole 5*a*.

First, the sleeve 4 is rotated in the direction indicated by the arrow in FIG. 26 until the initial developer has been sufficiently deposited on the sleeve 4 by the force of the magnet roller 5. The excess developer which cannot be magnetically deposited on the sleeve 4 is let fall onto the bottom of the casing 2.

Subsequently, the shutter 28 is pulled to the viewer's side with respect to FIG. 26. As a result, the excess developer existing on the bottom of the casing 2 is dropped into the bore 27 and prevented from depositing on the sleeve 4 during development. This successfully prevents the amount of the developer from varying during development. The shutter 29 is also pulled out to the viewer's side with respect to FIG. 26 in order to communicate the hopper 8 to the chamber 10. In this condition, the chamber 10 is ready to receive fresh toner from the hopper 8.

The shutters 28 and 29 once pulled out of the casing 2 are not mounted to the casing 2 again. Hence, they may each be implemented as a film-like seal.

In the embodiment, the pole 5*a* is so configured as to exert a magnetic force substantially uniformly in the axial direction of the sleeve 4. Therefore, only if the sleeve 4 is rotated to drop the excess developer to the bottom of the casing 2, the developer can be deposited on the sleeve 4 with a substantially uniform thickness throughout the axial dimension of the sleeve 4. This eliminates the need for a special mechanism for leveling the initial developer in the axial direction of the sleeve 4. Consequently, irregular development due to the localized deposition of the initial developer on the sleeve 4 is eliminated.

Because the bore 27 remains closed by the shutter 28 until the initial developer has been uniformly set on the sleeve 4, the initial developer is prevented from dropping into the bore 27 before the developer is deposited on the sleeve 4 in a sufficient amount.

If the shutter 28 is used, but the shutter 29 is omitted, then the toner in the hopper 8 can be prevented from entering the bore 27 before the excess developer is dropped into the bore 27.

When the shutter 28 is omitted, it is preferable to provide the initial developer in the chamber 10 with a toner concentration lower than the toner concentration for regular development, and to store such a developer in an amount greater than the amount which can be magnetically deposited on the sleeve 4.

If the toner concentration during development is excessively low, then it cannot desirably reproduce a photographic or similar solid image and is liable to cause its magnetic carrier to adhere to the drum 1. If the toner concentration during development is excessively high, it brings about irregularity in development. In light of this, the embodiment controls the toner concentration to about 15wt % to 25wt % during the course of development.

The prerequisite with the initial developer is that much magnetic carrier be contained therein and surely deposited on the sleeve 4 by the pole 5*a*. Another prerequisite is that the carrier be prevented from depositing on the drum 1. To meet these requirements, the initial developer stored in the chamber 10 has a toner concentration which is one-fourth to one half of the toner concentration for development.

In the above condition, the initial developer stored in the chamber 10 and exceeding the amount which can be retained by the pole 5*a* contains much magnetic carrier. Therefore, the developer can be surely attracted toward and retained on the sleeve 4. Consequently, when the sleeve 4 is rotated in the direction of arrow, the amount of the developer to drop into the bore 27 is reduced. Moreover, the toner concentration of the initial developer is substantially equal to the toner concentration after the consumption of the toner. Hence, when the shutter 29 is removed to communicate the hopper 8 to the chamber 10, a necessary amount of toner is transferred from the hopper 8 to the chamber 10 due to the automatic toner concentration control capability. Thereafter, the toner concentration can be controlled to the optimal value.

The position of the agitator 9 and the length of its blade are selected such that the outermost locus of rotation does not overlap the developer dropped into the bore 27 or the developer 3 deposited on the sleeve 4, as stated earlier. This prevents the agitator 9 from scooping up the dropped developer and returning it to the chamber 10. It follows that the developer in the chamber 10 does not vary in amount, and the developer 3 does not enter the hopper 8. In addition, the developer 3 deposited on the sleeve 4 is prevented from being scraped off by the agitator 9, so that the thickness of the developer 3 on the sleeve 4 remains uniform.

In summary, it will be seen that the present invention provides a developing device having various unprecedented advantages, as enumerated below.

(1) Use is made of a developer consisting of magnetic carrier and magnetic toner. Magnetic field generating means forms an electric field whose restricting force acts on both the magnetic carrier and the magnetic toner. As a result, friction acting between the carrier and toner is intensified to sufficiently charge the toner. The sufficiently charged toner is fed to a developing position even when the device is installed in a high-speed image forming apparatus. This protects the background of an image from contamination and prevents the toner from flying about. Such an advantage is not achievable with the conventional nonmagnetic toner.

(2) The developer has a mean density lower than its apparent density inclusive, as measured by JIS Z2504, over the range from the intermediate between a regulating position assigned to a developer regulating member and adjoining a developer storing chamber and a toner replenishing opening to the replenishing opening. In this range, therefore, the developer stays in a loosely packed state. When the toner concentration in the above chamber and therefore the volume of the developer increases, the replenishment of the toner into the developer ends. Even in this condition, the developer having a high toner concentration continuously turns round in the chamber in order to promote the dispersion and charging of the toner. When the toner is again taken into the developer due to the consumption of the toner, not only this toner but also the toner dispersed and charged due to the rotation during development are fed to the developing position. This obviates a decrease in image density ascribable to short toner supply, and background contamination and flying of toner ascribable to the short charge of toner.

(3) A developer storing member defining the above chamber has a surface including a portion facing the above range, but against which the developer is not pressed. This further promotes the rotation of the developer in the above range.

(4) The developer storing member is formed with an air vent at a position spaced from the regulating position assigned t the developer regulating member. Air is allowed to flow into and out of the above chamber via the air vent to thereby prevent the air pressure in the chamber from rising. This prevents the toner from flying about.

(5) The developer set in the above chamber has a toner concentration lower than the saturation toner concentration inclusive which is the upper limit allowing the toner to be stably contained in the developer deposited on a developer carrier. Hence, just after the developer has been set in the chamber, charge as high as a regular charge assigned to development can be deposited on the toner. This prevents the image density from increasing due to short charge.

(6) When the developer set in the chamber has a toner concentration which is 20% of the saturation toner concentration or above, the toner concentration of the developer deposited on the developer carrier just after the setting is prevented from decreasing below a preselected lower limit. This prevents the magnetic carrier from depositing on an image carrier.

(7) Assume that only the magnetic carrier fills the chamber and has its amount calculated on the basis of its apparent density measured by JIS Z2504. Then, the developer set in the chamber contains the magnetic carrier in an amount equal to or less than the calculated amount of the carrier. In this condition, the magnetic carrier is packed such that the toner can be sufficiently fed to the chamber, so that images are free from short density.

(8) The moving layer of the developer conveyed by the developer carrier sequentially varies in volume due to the replenishment of the toner into the developer. The toner is mainly taken into the developer at a position located at the interface between the moving layer and the chamber and adjoining the replenishing opening. When the moving layer expands due to the replenishment of the toner, the above position sequentially moves to a position where the replenishment is difficult. At the same time, the moving speed of the developer at the interface deceases. Consequently, the replenishment does not exceed a preselected amount and determines the upper limit of toner concentration; the toner concentration does not exceed the upper limit thereafter. The upper limit depends on the carrier concentration of the developer. Hence, if the magnetic carrier to be set in the chamber is so selected as to set up a desired upper limit beforehand, then the toner concentration is automatically controlled to the upper limit without regard to the particle size of the carrier. This provides images with desired density.

(9) In the condition setting up the upper limit of toner concentration, a gap exists in the chamber and promotes the rotation of the developer in the chamber. This surely charges the toner.

(10) The developer is sequentially interchanged between the moving layer on the developer carrier and the staying layer contacting the moving layer, so that all the developer existing in the chamber effectively contributes to development. This obviates the rapid deterioration of a developer to occur in the conventional developing device in which only the moving layer contributes to development.

(11) Even when the developer is returned from the chamber formed by the developer storing member toward the replenishing opening, an extension extending from the storing member blocks it. The developer is therefore surely confined in the range in which the magnetic force acts. Hence, the above developer can effectively contribute to the conveyance of the toner.

(12) The magnetic field generating means is located upstream of the replenishing opening in the direction in which the developer carrier conveys the developer. The pole of the field generating means causes the developer to form a magnet brush pressing itself against the part of the casing located below the developer carrier. The magnet brush prevents the toner in a toner holding chamber from dropping via the gap between the developer carrier and the casing to the outside of the developing device. This surely prevents the toner from flying about.

(13) A carrier covering ratio is calculated by use of an equation and in consideration of the particle size and true specific gravity of the carrier and those of the toner. The upper limit of toner concentration can be determined such that the carrier covering ratio is 100% or below. Therefore, even when the particle size of the carrier or that of the toner varies, a stable developed image is insured at all times without regard to the particle size.

(14) The upper limit of toner concentration is selected in consideration of the particle size and true specific gravity of the carrier and those of the toner. The upper limit can be set on the basis of the amount of the carrier of the developer set in the developer storing chamber. The device therefore freely adapts itself to the particle size of the carrier and that of the toner.

(15) Biasing means biases the developer carrier of the developing device toward the image carrier. As a result, the thin and uniform developer layer formed on the developer carrier by the regulating member sets the gap between the image carrier and the developer carrier. The conventional rollers or similar spacing members are undesirable because they wear and cause the above gap to vary. Assume the image carrier or the developer carrier is not accurately circular, as viewed in a section perpendicular to its axis. Then, the image carrier or the developer carrier is apt to oscillate in the radial direction, changing the above space. Even in this condition, the thickness of the thin developer layer cancels the change in gap and thereby maintains the gap constant.

(16) The carrier covering ratio is selected to be as high as 60% to 100%. Then, when the developer carrier is biased toward the image carrier by the biasing means, the probability that the image carrier and carrier contact each other is reduced. This obviates damage to the surface of the image carrier due to the carrier and occurring when the covering ratio is less than 60%.

(17) The field generating means disposed in the developer carrier attracts the magnetic toner toward the developer carrier together with the magnetic carrier. Hence, even when the charge of the toner is reduced due to the high covering ratio, the toner sparingly flies about, compared to the non-magnetic toner. This causes a minimum of background contamination to occur.

Various modifications will become possible for those skilled in the art after receiving the teachings of the present disclosure without departing from the scope thereof.

What is claimed is:

1. A developing device comprising:

a developer carrier conveying a developer consisting of a toner and a magnetic carrier and deposited thereon;

magnetic field generating means accommodated in said developer carrier;

a regulating member regulating an amount of the developer being conveyed by said developer carrier;

a developer storing chamber temporarily storing a part of the developer removed by said regulating member; and a developer holding chamber which holds the developer;

a toner storing chamber adjoining said developer storing chamber at an upstream side in a direction in which said developer carrier conveys the developer, and comprising an opening through which a toner stored in said toner storing chamber contacts the developer deposited on said developer carrier from said developer holding chamber and the developer existing in said developer storing chamber;

wherein the developer removed from said regulating member moves toward said opening in said developer storing chamber due to an internal pressure thereof and gravity, wherein the toner from said toner storing chamber is mixed with the developer from the developer holding chamber and is conveyed toward said regulating member along a surface of said developer carrier, and wherein the developer regulated to a preselected amount by said regulating member is fed to a developing position where said developer carrier faces an image carrier.

2. A device as claimed in claim 1, wherein the toner included in the developer comprises magnetic toner.

3. A developing device as claimed in claim 1, which comprises an agitator located in said developer holding chamber.

4. A developing device as claimed in claim 1, which comprises a magnet located in said developer holding chamber, said magnet separating the developer from the developer carrier.

5. A developing device as claimed in claim 1, which comprises a magnet located in said developer holding chamber, said magnetic preventing toner from entering the developer holder chamber from said toner storing chamber.

6. A developing device comprising:

a developer carrier conveying a developer consisting of a toner and a magnetic carrier and deposited thereon;

magnetic field generator accommodated in said developer carrier;

a regulating member regulating an amount of the developer being conveyed by said developer carrier;

a developer storing member facing a surface of said developer carrier and forming a developer storing chamber temporarily storing a part of the developer removed by said regulating member; and a toner storing chamber adjoining said developer storing chamber at an upstream side in a direction in which said developer carrier conveys the developer, and comprising an opening through which a toner stored in said toner storing chamber contacts the developer deposited on said developer carrier and the developer existing in said developer storing chamber, wherein the toner is taken into said developer from said toner storing chamber via said opening;

wherein in a range from substantially an intermediate between a regulating position assigned to said regulating member and adjoining said developer storing chamber and said opening to said opening, the developer has a mean density equal to or less than an apparent density of the developer, as measured by JIS Z2504 (metal powder apparent density test).

7. A device as claimed in claim 6, wherein a surface of said developer storing member includes a portion against which the developer does not press itself.

8. A device as claimed in claim 6, wherein an air vent is formed in said developer storing member.

9. A developing device comprising:

a developer carrier conveying a developer consisting of a toner and a magnetic carrier and deposited thereon;

magnetic field generator accommodated in said developer carrier;

a regulating member regulating an amount of the developer being conveyed by said developer carrier;

a developer storing member facing a surface of said developer carrier and forming a developer storing chamber temporarily storing a part of the developer removed by said regulating member; and a toner storing chamber adjoining said developer storing chamber at an upstream side in a direction in which said developer carrier conveys the developer, and comprising an opening through which a toner stored in said toner storing chamber contacts the developer deposited on said developer carrier and the developer existing in said developer storing chamber, wherein the toner is taken into the developer deposited on said developer carrier from said toner storing chamber via said opening;

wherein the developer set in said developer storing chamber has a toner concentration equal to or less than a saturation toner concentration which is an upper limit allowing the toner to be stably contained in the developer deposited on said developer carrier.

10. A device as claimed in claim 9, wherein the toner concentration is 20% of the saturation toner concentration or below.

11. A developing device comprising:

a developer carrier conveying a developer, the developer consisting of a toner and a magnetic carrier and deposited thereon;

magnetic field generator accommodated in said developer carrier;

a regulating member regulating an amount of the developer being conveyed by said developer carrier;

a developer storing member facing a surface of said developer carrier and forming a developer storing chamber temporarily storing a part of the developer removed by said regulating member;

a developer holding chamber which holds a developer; and a toner storing chamber adjoining said developer storing chamber at an upstream side in a direction in which said developer carrier conveys the developer, and comprising an opening through which a toner stored in said toner storing chamber contacts the developer deposited on said developer carrier from the developer holding chamber and the developer existing in said developer storing chamber, wherein the toner is taken into the developer deposited on said developer carrier from said toner storing chamber via said opening;

wherein the developer set in said developer storing chamber has a carrier concentration equal to or less than an amount in which the carrier would fill said developer storing section alone, as measured on the basis of an apparent density of the carrier by JIS Z2504.

12. A developing device as claimed in claim 11, which comprises an agitator located in said developer holding chamber.

13. A developing device as claimed in claim 11, which comprises a magnet located in said developer holding chamber, said magnet separating the developer from the developer carrier.

14. A developing device as claimed in claim 11, which comprises a magnet located in said developer holding chamber, said magnet preventing toner from entering the developer holding chamber from said toner storing chamber.

15. A developing device comprising a developer carrier accommodating magnetic field generating means therein, and causing said developer carrier to convey a developer deposited thereon and consisting of a toner and a magnetic carrier to a developing position where said developer carrier faces an image carrier to thereby develop a latent image formed on said image carrier, said device comprising:

a regulating member regulating an amount of the developer being conveyed by said developer carrier toward the developing position;

a developer storing member facing a surface of said developer carrier, and including a developer storing chamber adjoining said developer carrier at an upstream side in a direction in which said developer carrier conveys the developer; and a toner storing chamber adjoining said developer storing chamber from an upstream side in said direction, and including an opening facing said developer carrier;

wherein a gap exists in said developer storing chamber when the developer moving towards said opening reaches an upper limit of a toner concentration.

16. A device as claimed in claim 15, wherein said developer storing member includes a downward extension adjoining said opening and spaced a predetermined distance from said developer carrier.

17. A device as claimed in claim 15, wherein a magnetic pole included in said magnetic field generator and located upstream of said opening in said direction exerts a magnetic force of such a degree that a magnet brush formed by the developer on said developer carrier presses itself against a casing disposed below said image carrier.

18. A developing device, comprising:

a developer carrier accommodating a magnetic field generator therein, causing said developer carrier to convey a developer deposited thereon and consisting of toner particles and magnetic carrier particles to a developing position where said developer carrier faces an image carrier to thereby develop a latent image formed on said image carrier, and causing the developer to move in a developer storing chamber, contacting a surface of said developer carrier, to thereby replenish toner to the developer from a toner storing chamber which adjoins said developer storing chamber at an upstream side in a direction in which said developer carrier conveys the developer, the developer existing in said developer storing chamber having an upper limit of a toner concentration selected such that a carrier covering ratio Tn expressed by a following equation is 100% or below:

$$Tn = \frac{100C\sqrt{3}}{2\pi(100 - C) \cdot (1 + r/R)^2 \cdot (r/R) \cdot (\rho_t/\rho_c)}$$

wherein C is the toner concentration (wt. %), r is the radius of the toner particles ($\mu$m)$\pi_t$ is the true specific gravity (g/cm$^3$) of the toner particles, $\pi_c$ is the true specific gravity (g/cm$^3$) of the carrier particles and R is the radius of the carrier particles.

19. A device as claimed in claim 18, wherein the carrier covering ratio is between 60% and 100%.

20. A device as claimed in claim 18, wherein the upper limit is determined by an amount of the carrier particles of the developer set in said developer storing chamber.

21. A developing device comprising a developer carrier accommodating a magnetic field generator therein, and causing said developer carrier to convey a developer deposited thereon and consisting of a toner and a magnetic carrier to a developing position where said developer carrier faces an image carrier to thereby develop a latent image formed on said image carrier, said developer carrier being mounted on a body of said developing device such that said developer carrier is movable toward and away from said image carrier, said device comprising:

a spring biasing mechanism biasing said developing carrier toward said image carrier such that said layer formed on said developer carrier sets a gap between said developer carrier and said image carrier.

22. A device as claimed in claim 21, wherein a covering ratio of the carrier is between 60% and 100%.

23. A device as claimed in claim 22, wherein the toner comprises magnetic toner.

24. A developing device as claimed in claim 21, wherein said biasing mechanism comprises a leaf spring located on the developing device and a cam biasing the leaf spring.

25. A developing device comprising:

a developer carrier conveying a developer consisting of a toner and a magnetic carrier and deposited thereon;

a magnetic field generator accommodated in said developer carrier;

a regulating member regulating an amount of the developer being conveyed by said developer carrier, a free end portion of said regulating member being positioned in proximity with said developer carrier;

a developer storing chamber having a preselected capacity and temporarily storing a part of the developer removed by said regulating member;

a developer holding chamber which holds the developer:

a toner storing chamber adjoining said developer storing chamber at an upstream side in a direction in which said developer carrier conveys the developer, and comprising an opening through which a toner stored in said toner storing chamber contacts the developer deposited on said developer carrier and the developer existing in said developer holding chamber, wherein the toner is taken into the developer deposited on said developer carrier from said toner storing chamber via said opening; and a sensor positioned on a wall of said toner storing chamber above said opening and above said free end portion of said regulating member, said sensor sensing an amount of the toner remaining in said toner storing chamber.

26. A device as claimed in claim 25, further comprising a toner container disposed above said toner storing chamber supplying toner to said toner storing chamber.

27. A device as claimed in claim 25, wherein said sensor comprises a sensor contacting the toner stored in said toner storing chamber.

28. A device as claimed in claim 25, wherein a wall of said toner storing chamber includes a transparent member, and wherein said sensor comprises a sensor sensing the toner through said transparent member without contacting the toner.

29. A developing device comprising:

a developer carrier conveying a developer consisting of a toner and a magnetic carrier and deposited thereon;

a magnetic field generator accommodated in said developer carrier;

a regulating member regulating an amount of the developer being conveyed by said developer carrier;

a developer storing chamber having a preselected capacity and temporarily storing a part of the developer removed by the regulating member;

a toner storing chamber adjoining said developer storing chamber at an upstream side in a direction in which said developer carrier conveys the developer, and comprising an opening through which a toner stored in said toner storing chamber contacts the developer deposited on the developer carrier and the developer existing in said developer storing chamber, wherein the toner is taken into the developer deposited on said developer carrier from said toner storing chamber via said opening; and a sensor positioned on a wall of said toner storing chamber above said opening, and sensing an amount of toner remaining in said toner storing chamber;

a conveyor disposed in said toner storing chamber and being rotatable about a stationary shaft, said conveyor conveying the toner toward said opening, wherein said conveyor has an outermost locus of rotation and has a bottom defining a sensing level for said sensor at an uppermost portion of an interface where the toner stored in said toner storing chamber and the developer contact each other.

30. A developing device comprising:

a developer storing chamber temporarily storing a developer consisting of a toner and a magnetic carrier;

a developer carrier accommodating a magnet therein, and magnetically retaining the developer fed from said developer storing chamber thereon and conveying the developer while in rotation; and a toner storing chamber communicated to said developer storing chamber, and storing a toner therein, wherein the toner is taken into the developer being conveyed from said toner storing chamber;

wherein the developer is stored in said developer storing chamber in an amount greater than a limit which said developer carrier can magnetically retain, and wherein after the developer carrier has been rotated about an axis thereof a preselected number of times, initial toner is introduced into said toner storing chamber.

31. A developing device comprising:

a developer storing chamber temporarily storing a developer consisting of a toner and a magnetic carrier;

a developer carrier accommodating a magnet therein, and magnetically retaining the developer fed from said developer storing chamber thereon and conveying the developer while in rotation;

a toner storing chamber communicated to said developer storing chamber, and storing a toner therein, wherein the toner is taken into the developer being conveyed from said toner storing chamber;

an agitator rotatable for feeding the toner from said toner storing chamber to the developer; and a discharging portion for discharging a part of the developer not magnetically retained by said developer carrier to an outside of an outermost locus of rotation of said agitator below said agitator in a direction of gravity.

32. A developing device comprising:

a developer storing chamber temporarily storing a developer consisting of a toner and a magnetic carrier;

a developer carrier accommodating a magnet therein, and magnetically retaining the developer fed from said developer storing chamber thereon and conveying the developer while in rotation; and a toner storing chamber communicated to said developer storing chamber, and storing a toner therein, wherein the toner is taken into the developer being conveyed from said toner storing chamber;

wherein location initial developer equal in amount to the developer which said developer carrier can magnetically retain due to rotation is held in said developer holding chamber.

33. A device as claimed in claim 32, wherein the initial developer has a toner concentration selected such that a mean toner concentration under a regular image forming condition is ±30% of the toner concentration of the initial developer.

34. A developing device comprising:

a developer storing chamber temporarily storing a developer consisting of atoner and a magnetic carrier;

a developer carrier accommodating a magnet therein, and magnetically retaining the developer fed from said developer storing chamber thereon and conveying the developer while in rotation; and a toner storing chamber communicated to said developer storing chamber, and storing a toner therein, wherein the toner is taken into the developer being conveyed from said toner storing chamber;

wherein said toner storing chamber is formed with a discharging portion in a bottom thereof, and wherein an excess developer not magnetically retained on said developer carrier and left in said toner storing chamber is discharged through said discharging portion to a position where the excess toner will not be deposited on said developer carrier.

35. A developing device for an image forming apparatus, comprising:

a casing including a toner storing chamber storing a toner and a developer storing chamber temporarily storing a developer consisting of a toner and magnetic particles; and a rotatable developer carrier disposed in said casing, and facing an image carrier included in said image forming apparatus, and accommodating magnetic field generating means therein, and retaining the developer thereon, wherein the developer in said developer storing chamber forms a layer along a periphery of said developer carrier, wherein the toner is taken into said layer from said toner storing chamber, and wherein the developer is stored in said casing beforehand in an amount greater than an amount which said developer carrier can retain due to a magnetic force of said magnetic field generating means; and a bore receiving an excess developer dropped to a bottom of said casing due to gravity without being retained on said developer carrier such that the excess developer will not deposit on said developer carrier.

36. A device as claimed in claim 35, further comprising a seal member for sealing an open end of said bore.

37. A device as claimed in claim 35, further comprising a partition member partitioning said toner storing chamber and said developer storing chamber.

38. A device as claimed in claim 35, further comprising an agitator disposed in said toner storing chamber and positioned such that an outermost locus of said agitator does not overlap the developer deposited on said developer carrier or the excess developer dropped from said developer carrier.

39. A device as claimed in claim 35, wherein a developer initially introduced into said casing has a toner concentration lower than a toner concentration under a regular developing condition.

40. A developing device, comprising:

a developer carrier conveying a developer consisting of a toner and a magnetic carrier and which is deposited thereon;

a magnetic field generator accommodated in said developer carrier;

a regulating member regulating an amount of the developer deposited on said developer carrier;

a developer holding section within which a part of the developer blocked by said regulating member is held; and a toner storing section adjoining said developer holding section and storing the toner such that the toner contacts the developer;

wherein a condition in which the developer deposited on said developer carrier and the toner stored in said toner storing section contact each other changes in accordance with a change in toner concentration of said developer so as to vary a condition of replenishment of the toner into said developer; and wherein said developer held in said developer holding section is movable at a rate of 1 mm/sec or greater.

* * * * *